US007552684B2

(12) United States Patent
Montambault et al.

(10) Patent No.: US 7,552,684 B2
(45) Date of Patent: Jun. 30, 2009

(54) REMOTE-CONTROLLED VEHICLE DESIGNED TO BE MOUNTED ON A SUPPORT AND CAPABLE OF CLEARING AN OBSTACLE

(75) Inventors: Serge Montambault, Ste-Julie (CA); Nicolas Pouliot, Montreal (CA); Marco Lepage, St-Amable (CA); Jacques Michaud, Beloeil (CA); Pierre Latulippe, St-Amable (CA); Christophe Comte, Montreal (CA)

(73) Assignee: Hydro-Quebec, Montreal, Quebec (CA)

( * ) Notice: Subject to any disclaimer, the term of this patent is extended or adjusted under 35 U.S.C. 154(b) by 152 days.

(21) Appl. No.: 11/578,600

(22) PCT Filed: Apr. 15, 2005

(86) PCT No.: PCT/CA2005/000582

§ 371 (c)(1),
(2), (4) Date: Jun. 8, 2007

(87) PCT Pub. No.: WO2005/101600

PCT Pub. Date: Oct. 27, 2005

(65) Prior Publication Data

US 2008/0276823 A1 Nov. 13, 2008

(30) Foreign Application Priority Data

Apr. 15, 2004 (CA) ..... 2463188

(51) Int. Cl.
*B61B 7/00* (2006.01)
*B61B 12/00* (2006.01)

(52) U.S. Cl. ..... 104/112; 104/173.1

(58) Field of Classification Search ..... 104/112, 104/173.1, 182, 178, 179, 89
See application file for complete search history.

(56) References Cited

U.S. PATENT DOCUMENTS

| | | | | |
|---|---|---|---|---|
| 3,518,947 | A * | 7/1970 | Borst | 105/30 |
| 4,904,996 | A * | 2/1990 | Fernandes | 340/870.07 |
| 5,103,739 | A * | 4/1992 | Sawada et al. | 105/30 |
| 5,120,911 | A * | 6/1992 | Gazzola | 191/45 A |
| 6,494,141 | B2 * | 12/2002 | Montambault et al. | 104/112 |

(Continued)

FOREIGN PATENT DOCUMENTS

| | | |
|---|---|---|
| CA | 2 418 473 A1 | 8/2004 |

(Continued)

*Primary Examiner*—S. Joseph Morano
*Assistant Examiner*—Jason C Smith
(74) *Attorney, Agent, or Firm*—Buchanan Ingersoll & Rooney PC

(57) ABSTRACT

The invention concerns a remote-controlled vehicle designed to be mounted on a support and capable of clearing an obstacle on the support. The vehicle comprises first and second mobile frames. At least one articulated arm is mounted mobile on the first frame and a wheel is mounted on the articulated arm to maintain the vehicle on the support. A fastening means co-operates with the wheel and is adapted to retain the wheel on the support. At least one temporary support arm is mounted mobile on the second frame. The temporary support arm comprises retaining means for maintaining the vehicle on the support. The vehicle comprises motor means connected between the frames and the arms for moving same with respect to one another so as to clear an obstacle encountered on the support.

12 Claims, 33 Drawing Sheets

U.S. PATENT DOCUMENTS

| | | | | |
|---|---|---|---|---|
| 7,299,752 | B1 * | 11/2007 | Cylvick et al. | 104/178 |
| 2006/0150857 | A1 * | 7/2006 | Pouliot | 104/112 |
| 2008/0202375 | A1 * | 8/2008 | Quattlebaum | 104/112 |
| 2008/0276823 | A1 * | 11/2008 | Montambault et al. | 104/173.1 |

FOREIGN PATENT DOCUMENTS

| | | | |
|---|---|---|---|
| WO | WO 2004/070902 | A1 | 8/2004 |

* cited by examiner

REMOTE-CONTROLLED VEHICLE DESIGNED TO BE MOUNTED ON A SUPPORT AND CAPABLE OF CLEARING AN OBSTACLE

FIELD OF THE INVENTION

The present invention relates to an improvement to the family of small remote-controlled vehicles designed to travel on aerial conductors, such as those used in the field of transmission of electrical energy, and which may or may not be exposed to live voltages. In English, such vehicles are called: "Remotely Operated Vehicles" or "ROV's". In particular, the invention relates to mechanical carriers used to transport sensors or existing equipment so as to access the different sections of the conductors.

BACKGROUND OF THE INVENTION

The present world context regarding the exploitation of an electrical energy transmission network is the following: ageing components, increasing demand for energy, deregulation and opening of markets, increasing pressure from clients for quality and reliable energy. The electrical utilities are therefore required to know precisely the state of their transmission network in order to apply the principles of preventive maintenance for safekeeping the reliability of the systems. The state of a component is evaluated, inter alia, through measurements by means of sensors. With regard to the gathering of information, numerous sensors have been developed but the positioning of these sensors, in order to access the components, often remains an important challenge. The use of remote-controlled vehicles (ROV) for this task in order to achieve the inspection of circuits of conductors is therefore very appropriate.

Many vehicles of the ROV type have been developed in the past. A quick overview will bring forward the characteristics and disadvantages of the main ones.

Known in the art, there is a remote-controlled line chariot for the inspection of circuits with a simple conductor and which is the object of U.S. Pat. No. 6,494,141 (MONTAMBAULT et al.). This remote-controlled vehicle is very efficient, compact, relatively light and easy to use. It also has a good traction force which renders it very versatile. It is a third generation prototype that has proven many times over its efficiency, its mechanical robustness and its robustness to work under live electrical conditions (315 kV, 1000 A). It allows the de-icing of overhead ground wires and of conductors, thermographic and visual inspections and the measurement of the electrical resistance of sleeves. It travels on simple conductors regardless of their diameters. However, even if this type of ROV is capable to pass over mid-span jointing sleeves, it cannot pass over on its own pylons, vibration dampers or spacers. It has to be removed when it reaches an insurmountable obstacle and has to be mounted back again on the other side of the obstacle.

Also known in the art, there exists the international patent application published under no. WO 2004/070902 A1 (POULIOT et al.) that discloses a remote-controlled vehicle having temporary support rotors that allow it to clear obstacles of greater dimensions than the previous one. However, this vehicle cannot clear certain large obstacles such as aerial warning markers that are mounted on certain conductors, on pylons or other diverse objects encountered on the conductive cables.

There exist other vehicles that specifically aim to solve the problem of clearing pylons. Indeed, hereinbelow, there are described a few experimental prototypes that clear obstacles on simple conductors.

An example of a remote-controlled vehicle that can clear obstacles is known under the name of NSI Power Line Inspection System. This vehicle was developed together with NASA. This vehicle travels on the conductor and can clear objects in the manner of a caterpillar. This vehicle aims mainly to provide visual inspection, but also the addition of sensors of all sorts for the inspection of all the components of the line.

FIG. 1 shows a vehicle that is known under the name of TVA Line ROVER. This vehicle was developed by the Tennessee Valley Authority Society at the beginning of the 1990's, in order to inspect power lines. This vehicle travels on the conductor and can clear certain obstacles thanks to arms that allow it to move temporarily in the manner of a spider.

FIG. 2 shows a vehicle designed by SAWADA et al. It is a line robot that is quite complex and that is able to clear obstacles such as insulator strings and vibration dampers. This vehicle also aims the visual inspection and the diagnostic of line components. There are more details provided about this type of vehicle in U.S. Pat. No. 5,103,739 (SAWADA et al.).

These last three vehicles are relatively large, heavy, cumbersome, complex and difficult to install. It is not clear to know if these are capable to work under live electrical conditions. The configuration of these vehicles tends to make them susceptible to stability and fragility problems.

As mentioned above, power transmission networks include a large variety of components that would be advantageous to be able to clear with a remote-controlled vehicle of the ROV type.

There is therefore a need in this field for a remote-controlled vehicle intended to be mounted on a cable, which would be relatively compact and would be less susceptible to stability and fragility problems of the vehicles known in the art and that could be able to clear, in a relatively short time, a large variety of obstacles that are found on the cables of the power transmission networks.

SUMMARY OF THE INVENTION

The present invention relates to a remote-controlled vehicle intended to be mounted on a support and capable to clear an obstacle on the support, the vehicle comprising:

- a first frame (7);
- a second frame (20) movably mounted on the first frame (7);
- a first motor means connected between the first and second frames (7, 20) for longitudinally displacing the frames (7, 20) one with respect to the other between a compact position where the frames (7, 20) are superimposed one over the other and an extended position where the frames (7, 20) are moved away from one another;
- at least one articulated arm (12) movably mounted on the first frame (7);
- at least one wheel (4) mounted on the articulated arm (12) for holding the vehicle (1) onto the support (2), said at least one wheel (4) being a motorized traction wheel capable of displacing the vehicle (1) along the support (2);
- attachment means (15) cooperating with said at least one wheel (4) and being capable of holding said wheel (4) on the support (2);

a second motor means connected between the first frame (7) and the articulated arm (12) for vertically displacing and pivoting the articulated arm (12) with respect to the first frame (7) so as to displace said at least one wheel (4) with respect to the support (2) between a removed position where said at least one wheel (4) is taken off from the support (2) and a support position where said at least one wheel (4) is mounted on the support (2);

at least one temporary support arm (22) movably mounted on the second frame (20), said at least one arm having a holding means (6) of the support (2), being capable of holding the vehicle (1) on the support (2); and a third motor means connected between the second frame (20) and the temporary support arm (22) for displacing vertically the temporary support arm (22) so as to raise and lower the holding means (6) between a high position where the holding means (6) is hanged on the support (2) and a lower position where the holding means (6) is taken off from the support (2).

The invention as well as its numerous advantages will be better understood by the following non-restricted description of preferred embodiments of the invention made in reference to the figures.

DETAILED DESCRIPTION OF THE INVENTION

Figure 1:
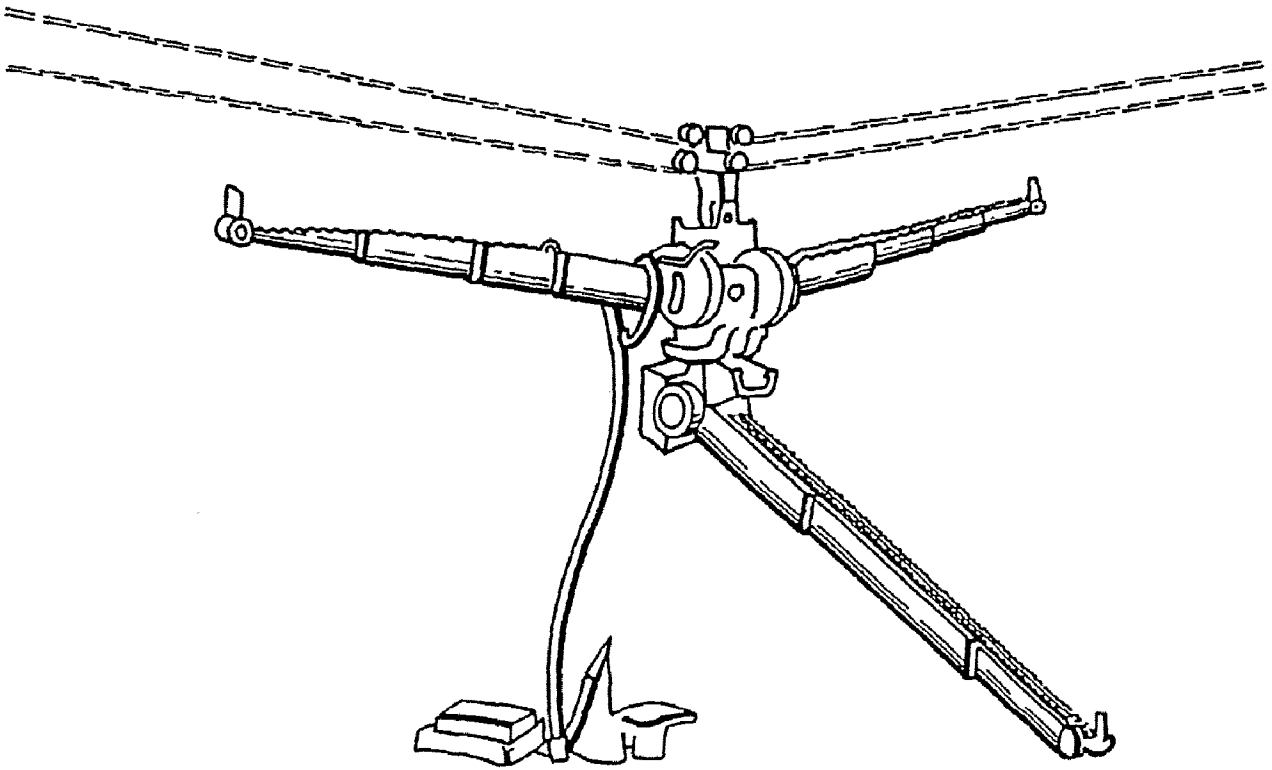
PRIOR ART FIG. 1
FIGS. 1 and 2 are perspective views of two apparatus known in the art and that are designed to be mounted on conductive cables.
Figure 2:
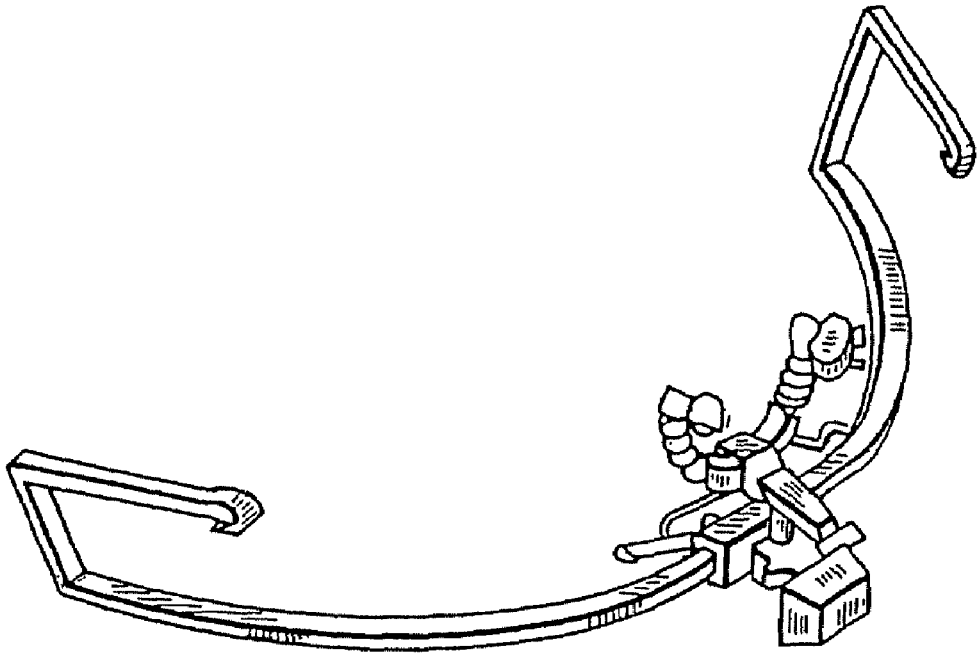
FIG. 2 PRIOR ART

Referring to FIGS. 3*a* to 3*h*, there is shown schematically a remote-controlled vehicle 1, according to a preferred embodiment of the present invention. The vehicle 1 is mounted on a support 2 and proceeds to the clearing of an obstacle 3, according to a preferred method to clear the vehicle 1 with respect to the obstacle 3.

It is to be noted that the support 2 may be an aerial conductive cable of an electrical distribution network. Of course, people skilled in this field will understand that the support 2 may take many different other forms for other types of applications. For example, the support 2 may be alternatively: a tube containing electrical conductors, a guy wire for supporting a telecommunication tower, a cableway track rope, a tubular structure made of steel ("truss") being part of the roof of a building, etc. The capacity of the vehicle according to the invention to clear different obstacles in these other contexts may open the door to many other tasks of inspection or intervention.

The remote-controlled vehicle 1, of which a preferred embodiment is illustrated in more details in FIGS. 5 to 8, has a first frame 7 and a second frame 20 movably mounted on the first frame 7. A first motor means, which will be described in detail further below, is connected between the first and second frames 7, 20 for longitudinally displacing the frames 7, 20 one with respect to the other between a compact position where the frames 7, 20 are superimposed one over the other, as illustrated for example in FIG. 3*a*, and an extended position where the frames 7, 20, are moved away from one another, as illustrated for example in FIG. 3*b*. The vehicle 1 has at least one articulated arm 12 movably mounted on the first frame 7. At least one wheel 4 is mounted on the articulated arm 12 for holding the vehicle 1 onto the support 2, as illustrated for example in FIG. 3*a*. Preferably, the vehicle has two articulated arms 12 mounted on the first frame 7 and longitudinally spaced from one another. In that case, the arms 12 each have a wheel 4 and at least one of the two wheels 4 is a motorized traction wheel capable of displacing the vehicle 1 along the support 2. An attachment means 15, which will be described in more details below, cooperates with the at least one wheel 4 and is capable of holding the wheel 4 on the support 2. A second motor means, which will be described in more detail below, is connected between the first frame 7 and the articulated arm 12 for vertically displacing and pivoting the articulated arm 12 with respect to the first frame 7 so as to displace the at least one wheel 4 with respect to the support 2 between a removed position where the at least one wheel 4 is taken off from the support 2, as illustrated for example in FIG. 3*d*, and a support position where the at least one wheel 4 is mounted on the support 2, as illustrated for example in FIGS. 3*a* to 3*c*. The vehicle 1 also has at least one temporary support arm 22 movably mounted on the second frame 20. The temporary support arm 22 has a holding means 6 of the support 2 that is capable of holding the vehicle 1 on the support 2. A third motor means, which will be described in more details below, is connected between the second frame 20 and the temporary support arm 22 for displacing vertically the temporary support arm 22 so as to raise and lower the holding means 6 between a high position where the holding means 6 is mounted on the support 2, as illustrated for example in FIG. 3*c*, and a lower position where the holding means 6 is taken off from the support 2, as illustrated for example in FIG. 3*g*.

It is to be noted that the expression first frame 7 is equivalent to the expression "frame of the wheels"; and the expression second frame 20 is equivalent to the expression "supports frame". FIGS. 3*a* to 3*h* show the vehicle 1 in different operating positions that illustrate a preferred method of clearing an obstacle 3 on a support 2 which may be a conductor.

Figure 3A:
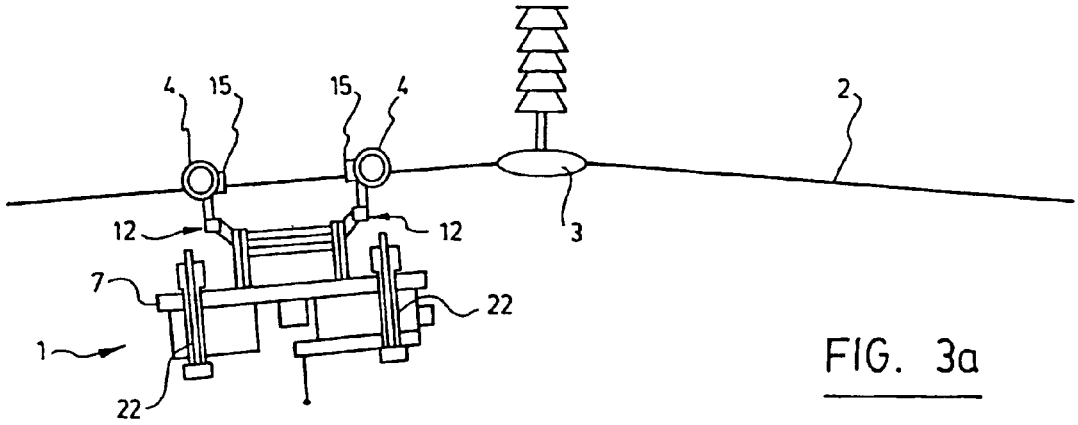
FIGS. 3*a* to 3*h* are schematics side views of a vehicle according to a preferred embodiment of the present invention in different operating positions that illustrate a preferential method of clearing an obstacle on a conductor.

Referring to FIG. 3*a*, there is shown that the vehicle 1 rests on the support 2, which is in this case a conductor, through two motor wheels 4 that allow it to move on the support 2 and clear the obstacle 3. The vehicle 1 is suspended under the support 2. This configuration is simple, efficient, already validated and even allows to clear certain objects or obstacles such as vibration dampers of the "Stockbridge" type by simply rolling over it. For securing the hold on the support 2, one extends the attachment means 15 that may include security rollers, as is described in more detail below, under the traction wheels 4 of the vehicle 1 and around the support 2.

Figure 3B:
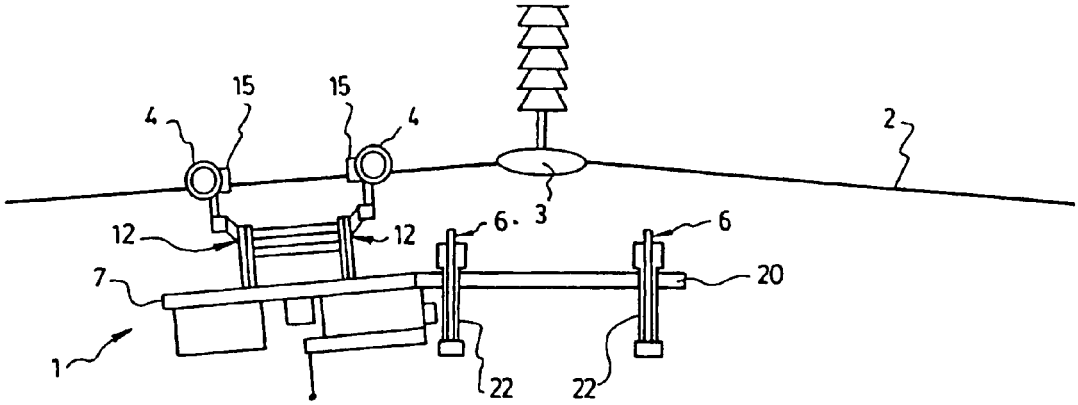
Figure 12A:
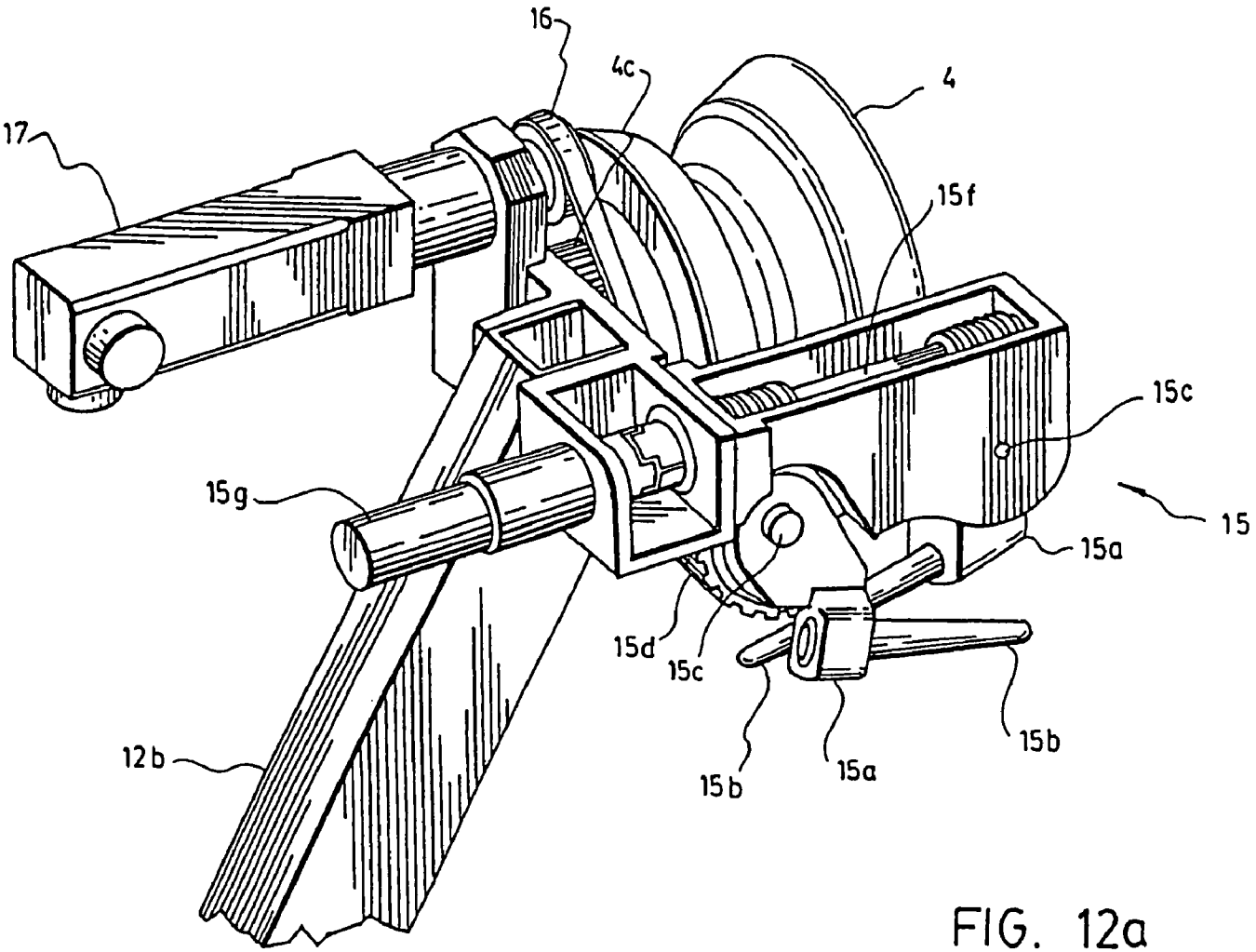
FIGS. 12*a* and 12*b* are perspective views of a part of the vehicle shown at FIG. 5 that illustrate respectively the traction wheel mounted on a carrying arm with security rollers in close and open positions.
Figure 12B:
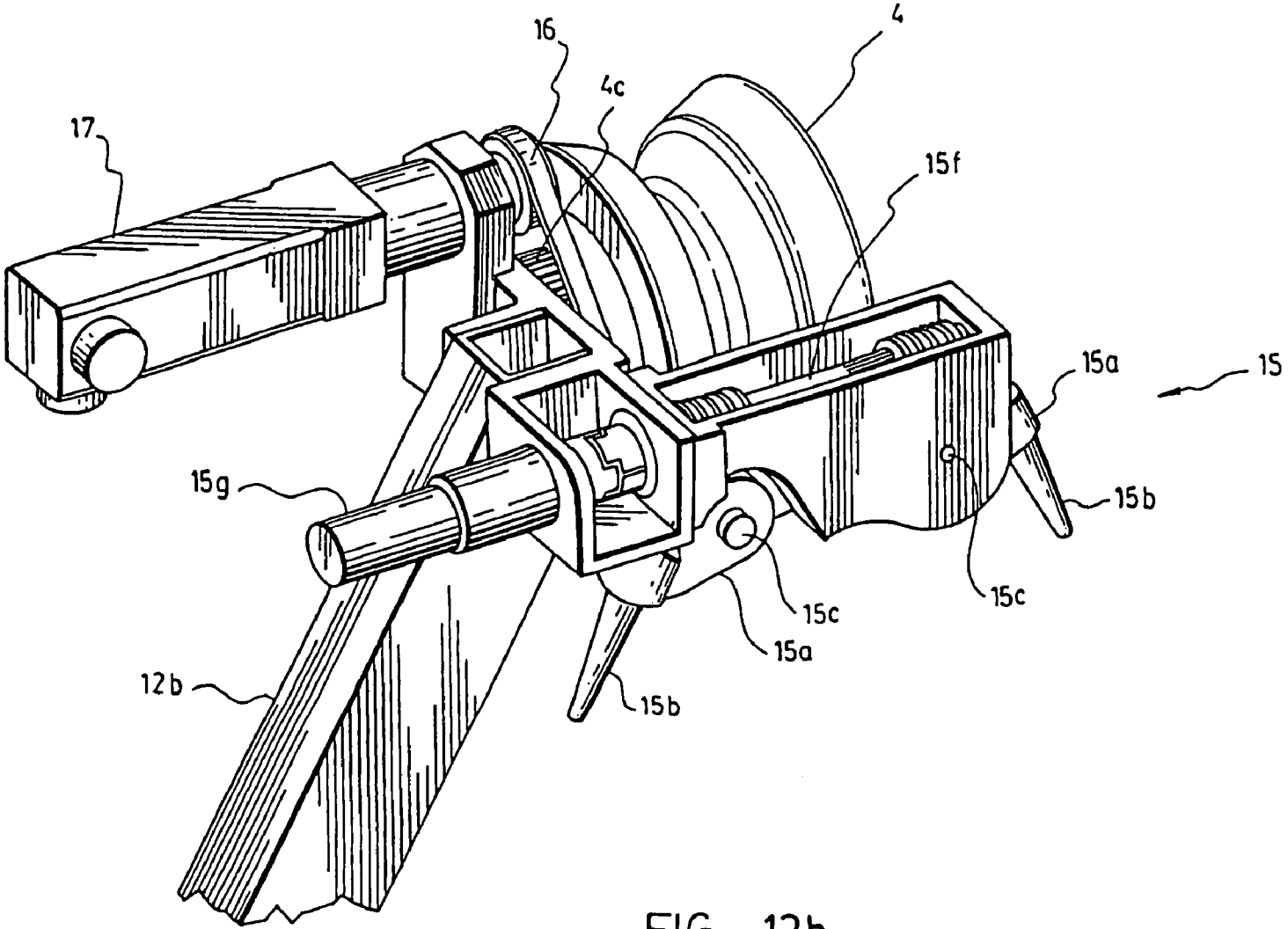

Referring to FIG. 3*b*, a first step to accomplish, to clear the obstacle 3 is to ensure that the attachment means 15 is closed around the support 2. As shown in FIGS. 12*a* and 12*b*, the first attachment means 15 may comprise rollers 15*b* that are deployed around the conductor 2, as will be explained in more details below. The second frame 20 moves thereby longitudinally with respect to the first frame 7 and extends under the obstacle 3. Two temporary support arms 22 each having a holding means 6 of the support 2 are positioned on each side of the obstacle 3. This extension may be achieved by the judicious combination of translation and rotation movements around a horizontal axis, perpendicular with respect to the support 2.

Figure 3C:
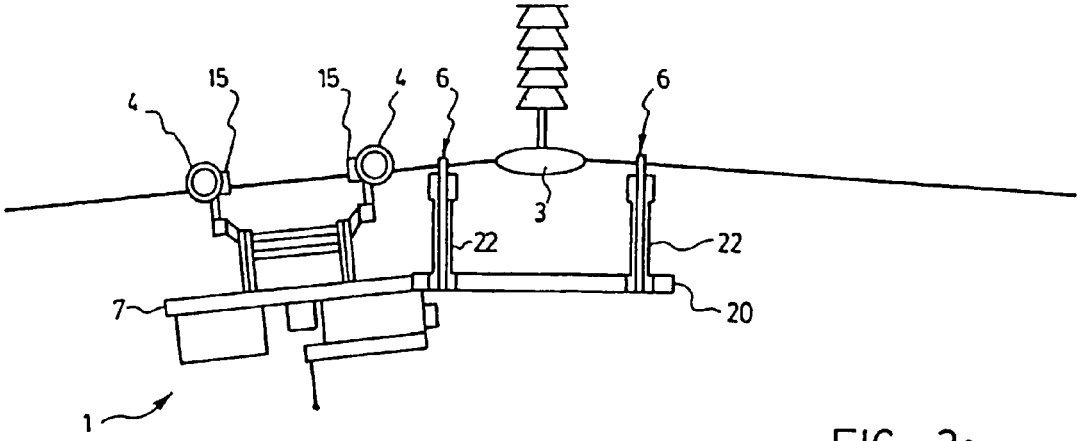

Referring to FIG. 3*c*, when each holding means 6 is well positioned, the temporary support arms 22 rise to meet the support 2 and each holding means 6 comes and is attached to it solidly. There is therefore, momentarily, a redundant hold with four supports, until the attachment means 15 are disengaged and release the traction wheels 4.

Figure 3D:
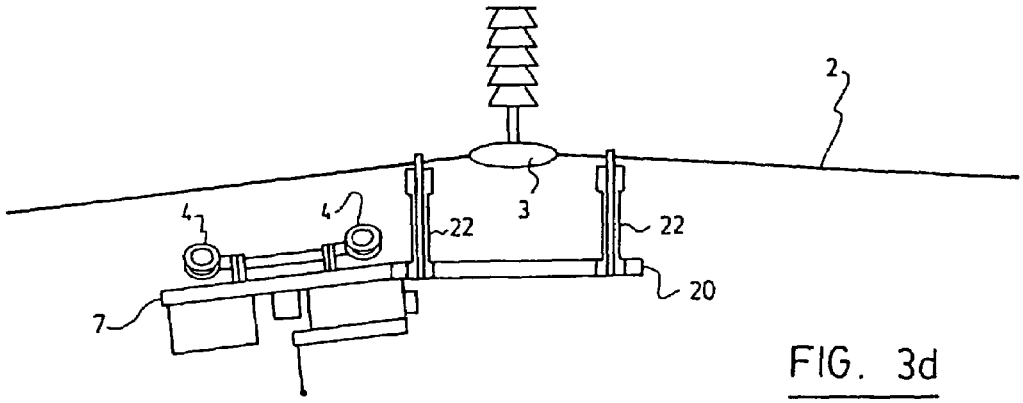

Referring to FIG. 3*d*, a mechanism disengages afterwards the traction wheels 4, first by taking them away from the conductor 2, then by bringing them back under this one, at a distance that is sufficient to avoid touching the obstacle 3 during the next step.

Figure 3E:
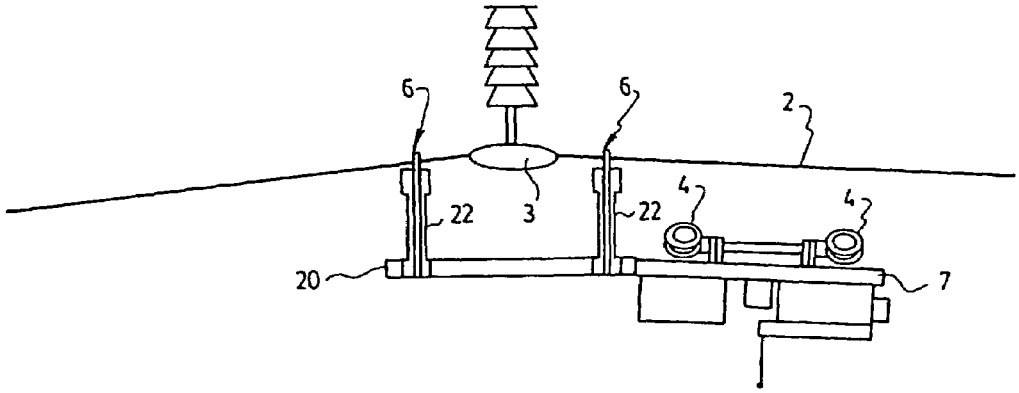

Referring to FIG. 3*e*, the first frame 7 moves longitudinally with respect to the second frame 20 and thereby allows to a part of the vehicle 1 to completely clear of the obstacle 3, by sliding underneath it. Preferably, as will be described below, a rotation movement may also be carried out between the first and second frames 7, 20.

Figure 3F:
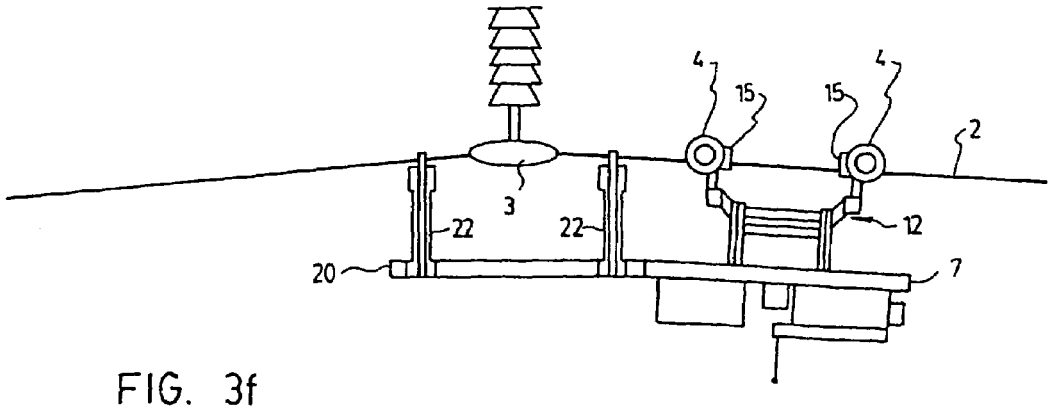

Referring to FIG. 3*f*, the mechanism for disengaging the wheels 4 is inversed and brings up the wheels 4 onto the conductor 2, and then this is followed by the closing of the attachment means 15, such as the security rollers 15*b* that again achieve a redundant hold with four supports.

Figure 3G:
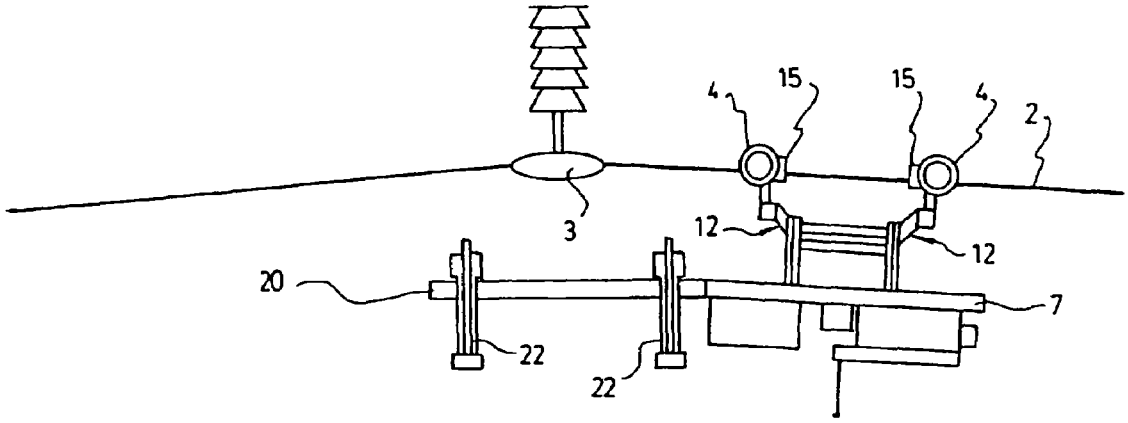

Referring to FIG. 3*g*, the holding means 6 of the support 2 may then open again and go down to the inferior level.

Figure 3H:
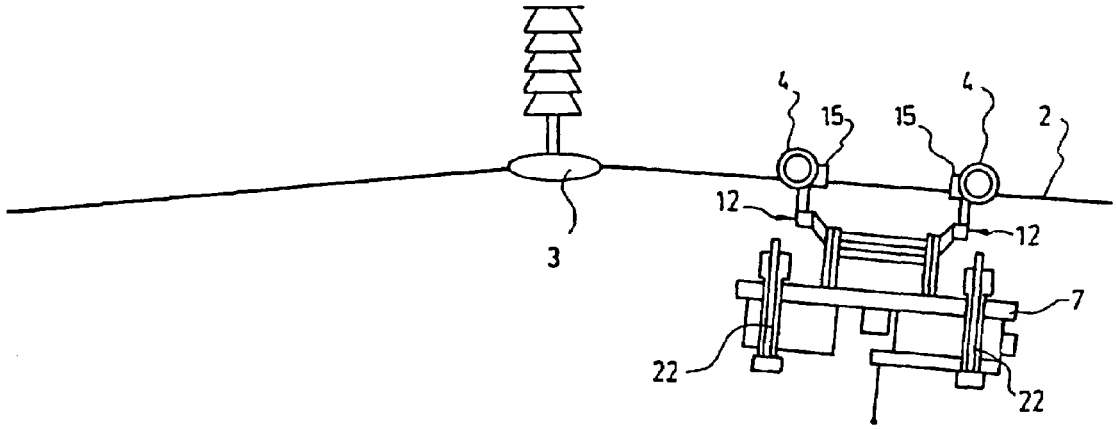

Referring to FIG. 3*h*, a translation movement allows bringing back the second frame 20 to its initial position. The vehicle 1 may then continue to roll on the conductor 2. It is thereby possible to open the attachment means 15 that takes a hold under the conductor if the conditions require it, to facilitate the displacement of the vehicle 1.

The above steps thereby allow a vehicle 1 to clear at least one obstacle 3. However, it is possible to achieve different other modes to clear obstacles with the vehicle 1 according to the present invention in order to fully exploit its versatility. These ways of doing things are especially useful to be adapted to a series of distinct obstacles that are closed to one another, as for example a series of torsion dampers. This possibility of adaptability is one of the great advantages of the concept with respect to other known prototypes.

Figure 3I:
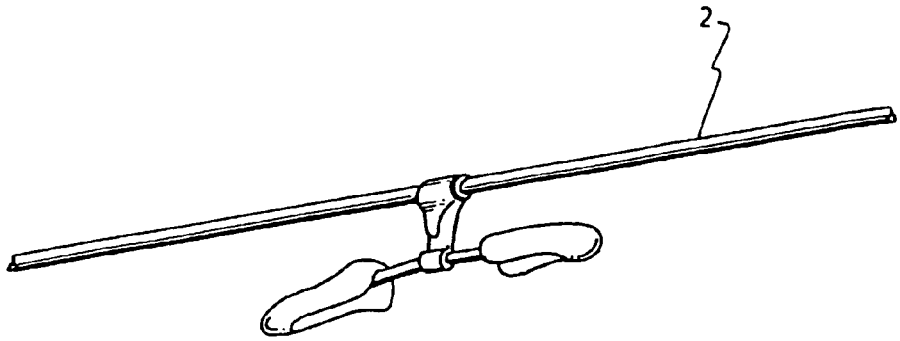
FIG. 3*i* to 3*k* are perspective views of different obstacles that are found on conductors.
Figure 3J:
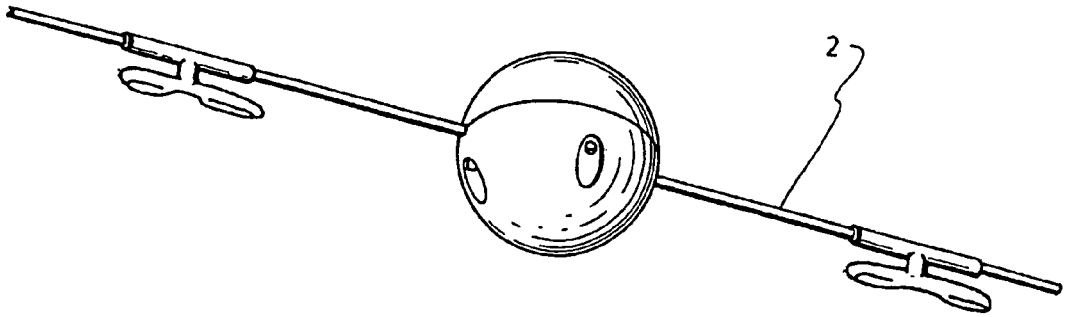
Figure 3K:
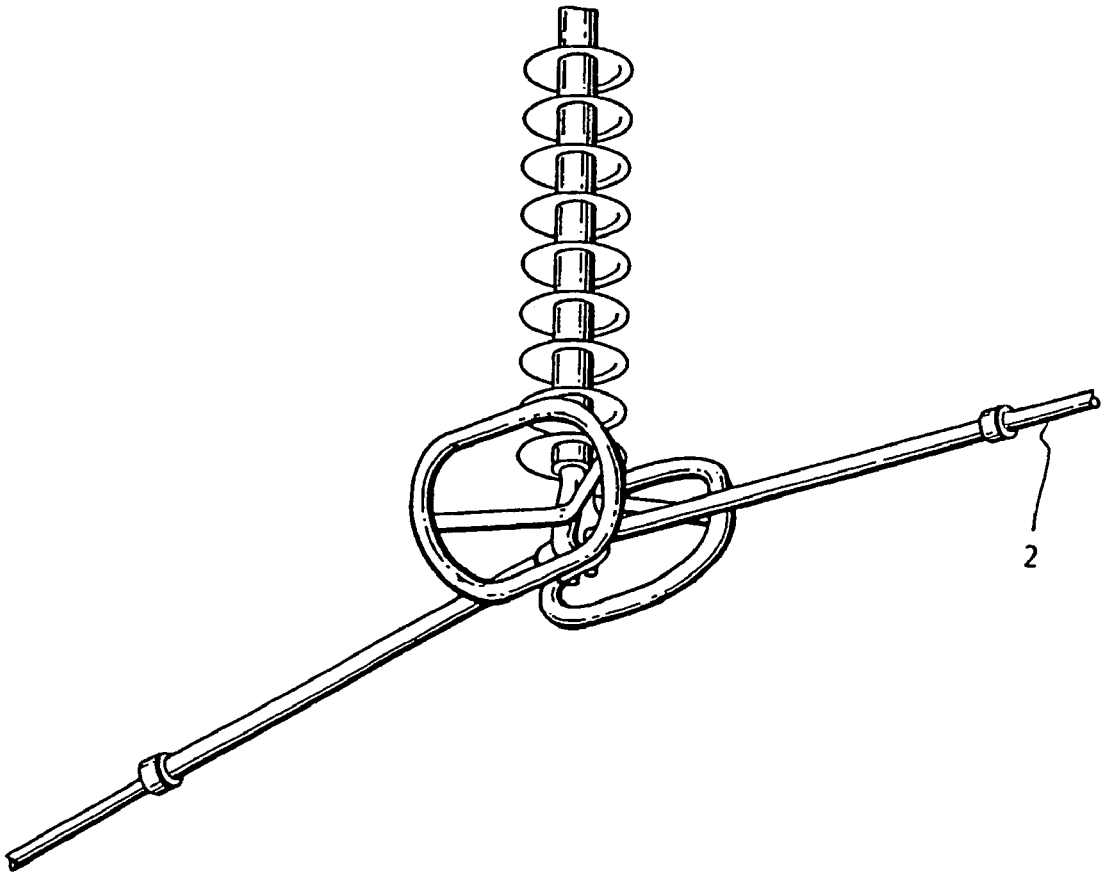

Referring to FIGS. 3*i* to 3*k*, there is shown examples of obstacles that may be cleared by a vehicle 1 according to the present invention. FIG. 3*i* shows a vibration damper with sprung mass. FIG. 3*j* shows an aerial marker and two vibration dampers with sprung mass on each side. FIG. 3*k* shows grading rings.

As will be understood by the persons of this field, several tools or sensors, carried out with existing equipment or specifically developed for this application may be mounted on one or the other of the subsystems of the vehicle, depending on the intended use.

Figure 9:
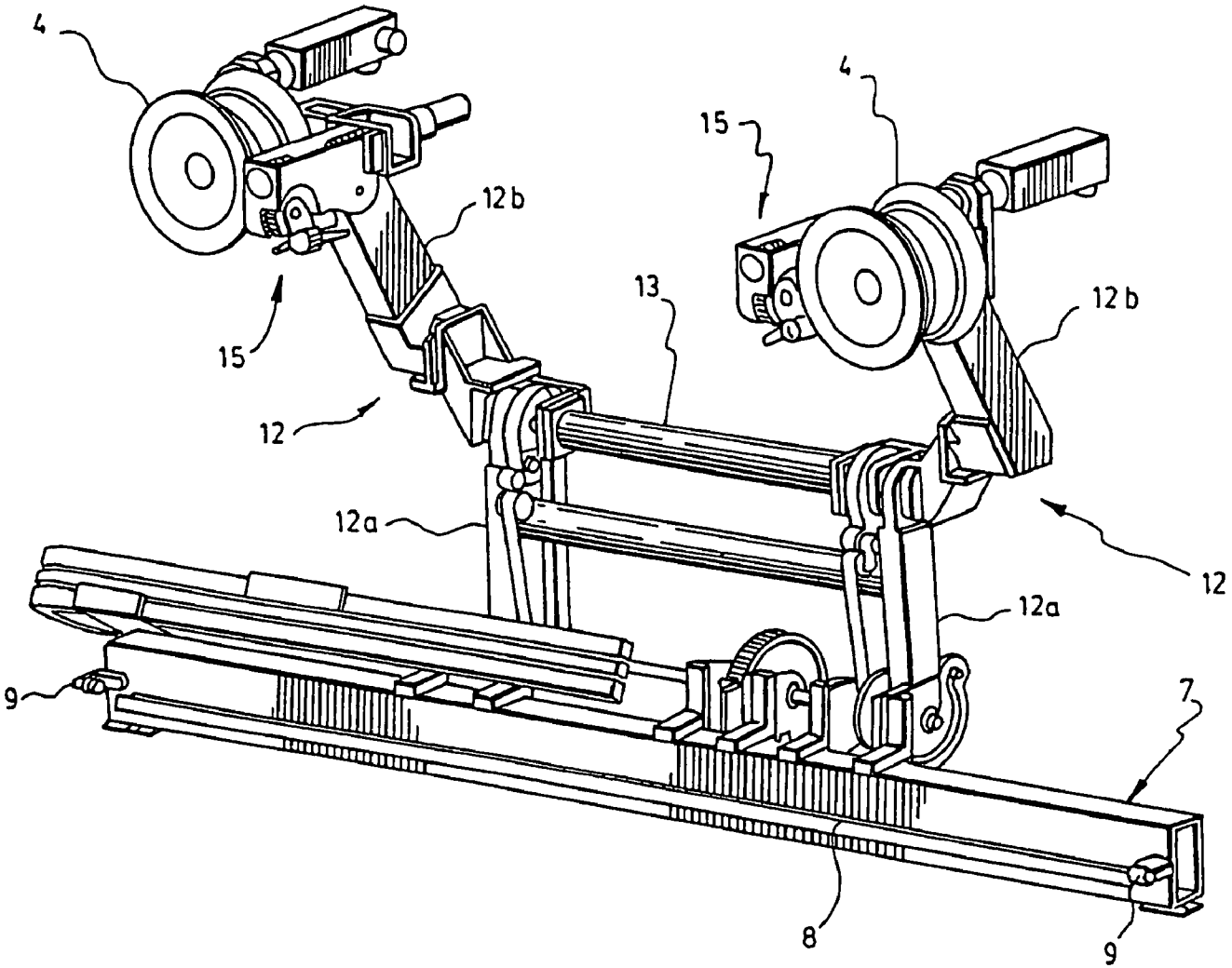
FIG. 9 is a perspective view of a part of the vehicle shown at FIG. 5 showing a first frame supporting the wheels.
Figure 10:
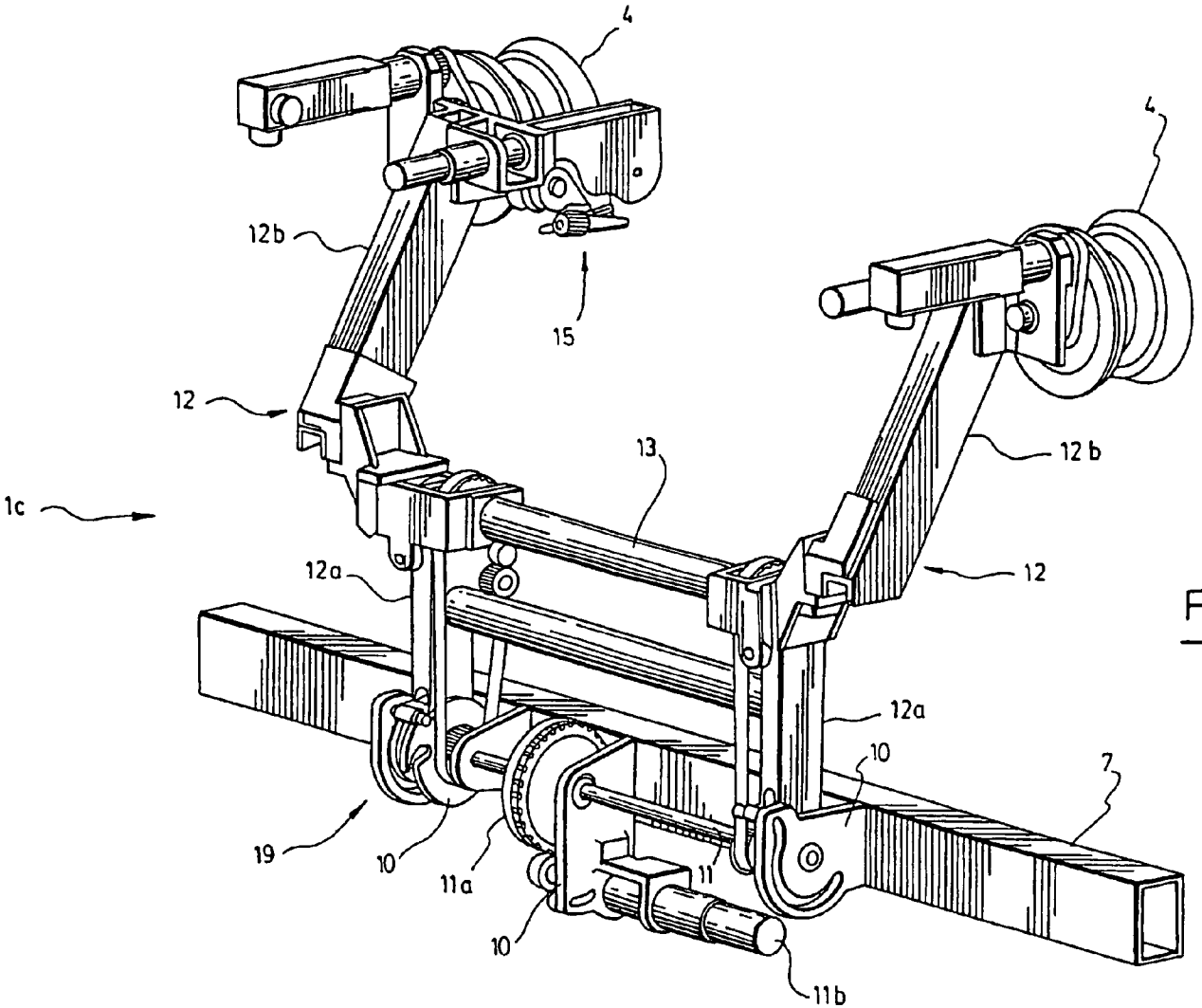
FIG. 10 is a back and perspective view of the part of the vehicle shown at FIG. 9.

Referring to FIGS. 9 and 10, the first frame 7 may have a rectangular tubular structure that supports a rail 8 that is used to guide the translation of the first and second frames 7 and 20. This rail 8, as well as the blocks that will slide on it, are chosen so as to be able to resist to a moment of force parallel to the rail 8. There is provided two mechanical stoppers 9 at the extremities of the rail 8 for limiting the translation movement.

Figure 13:
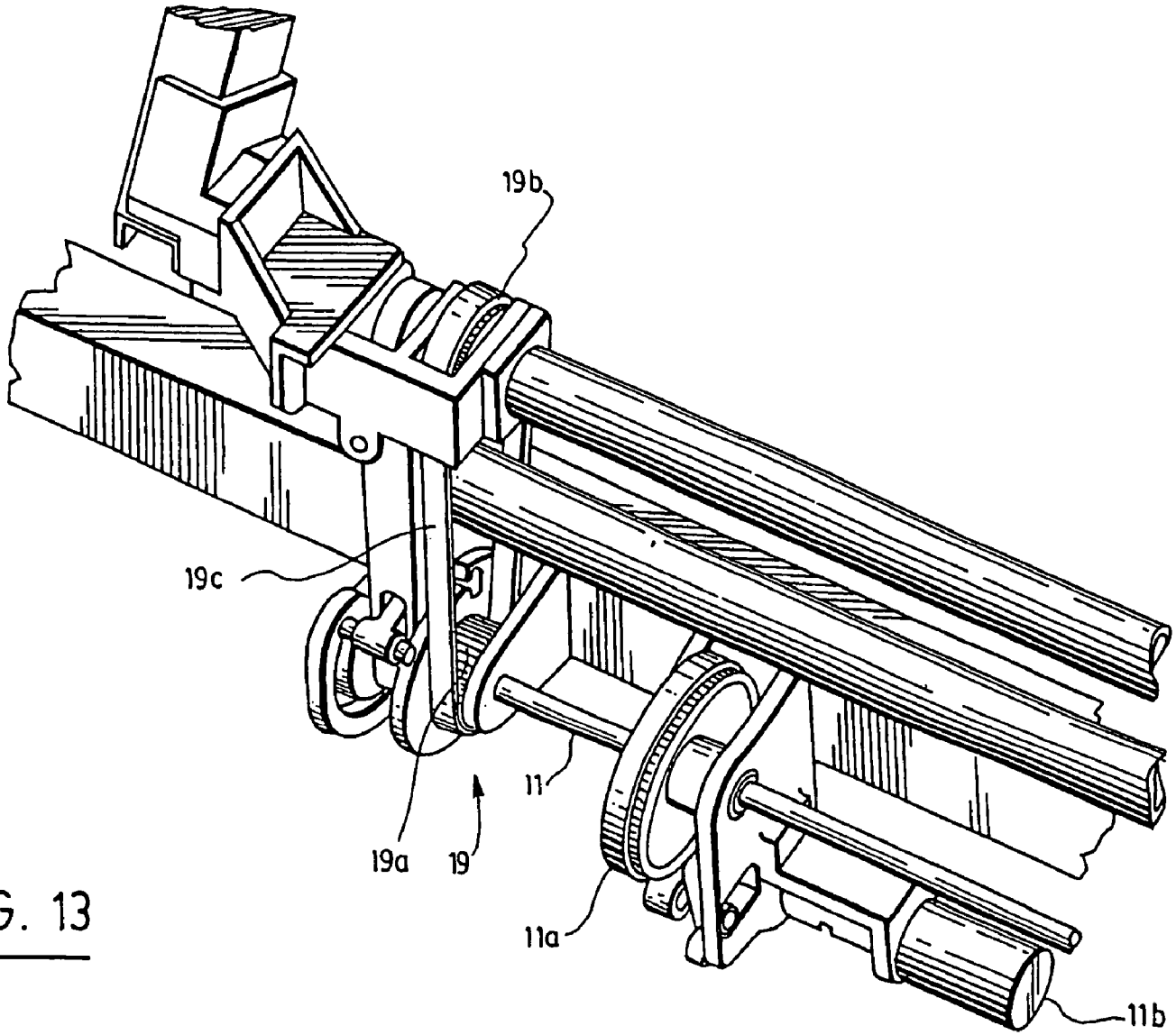
FIG. 13 is a perspective view of a wheels clearing system of the vehicle shown at FIG. 5.

FIG. 10 shows that the first frame 7 having a tubular structure also supports a series of parallel plates 10, which are themselves placed perpendicularly to the rectangular tubular structure on its external face. These plates 10 are used as a support to a movement transmission shaft 11, which is activated via a set of reduction ratio pulleys 11*a* by a motor 11*b* which are best illustrated at FIG. 13. Two articulated structural arms 12, parallel and linked to one another pivot around this transmission shaft 11. These arms 12 are furthermore made of two different sections, that is proximal sections 12*a* and distal sections 12*b*. There is therefore an intermediary pivot 13 between the two sections 12*a* and 12*b*. The distal section 12*b* supports at each extremity a set made of a motorized traction wheel 4 and of an attachment means 15, which may be a motorized security roller system.

The persons skilled in the art of this field will understand that it is not absolutely necessary that the attachment means 15 be mounted on each articulated arm 12. Indeed, the attachment means 6 may be mounted on another arm, independent of the articulated arms 12, onto which are mounted the wheels 4, and vise-versa.

Figure 11:
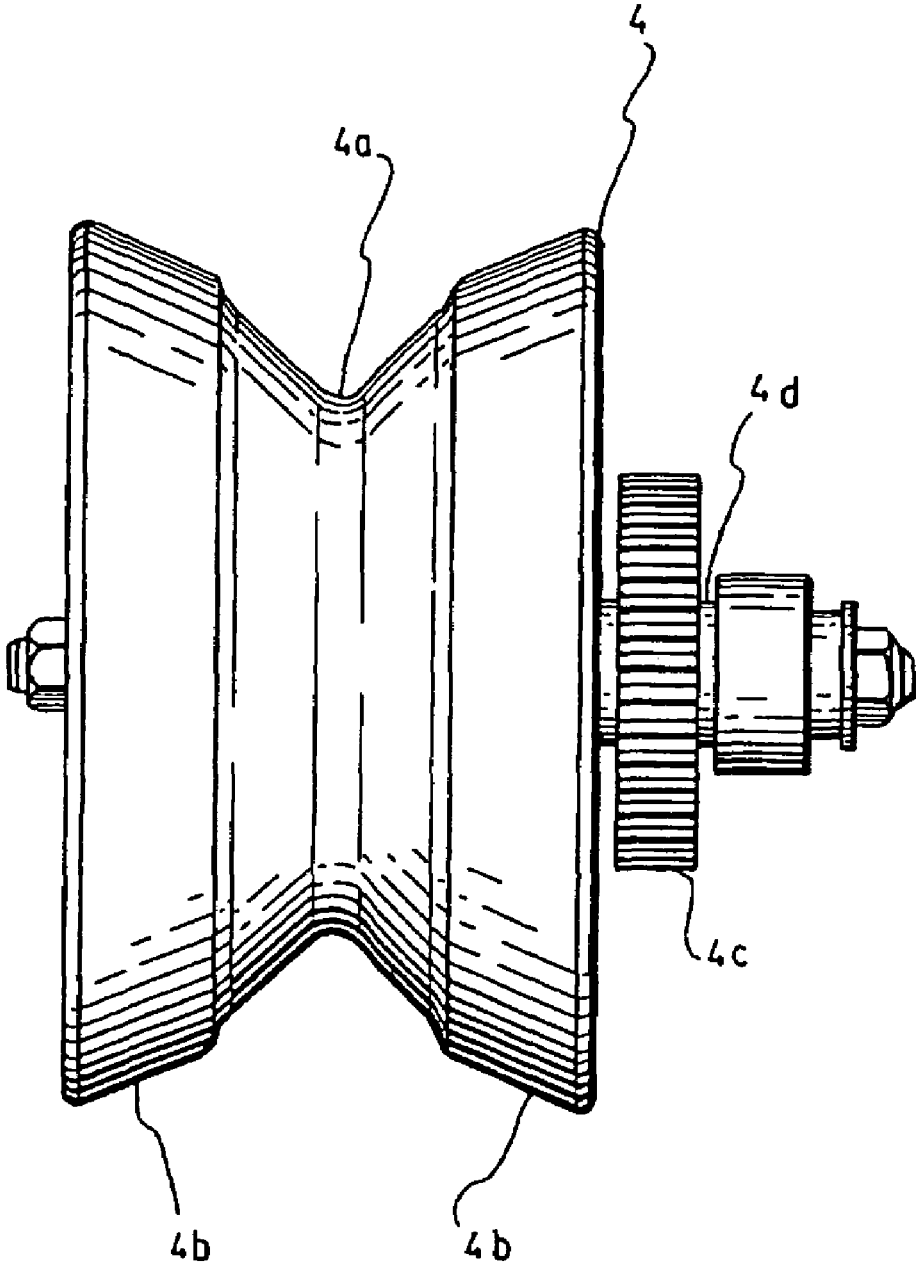
FIG. 11 is a front view of a traction wheel of the vehicle shown at FIG. 5.

The motorized traction wheels 4, shown sideways at FIG. 11, allow accommodating different diameters of conductors by means of a profile having a central groove 4*a* and splayed edges 4*b* for facilitating the passage of the obstacles 3 onto which it is possible to roll. The wheel 4 may be made of rubber, of polyurethane or of another material having low hardness in order to maximize the friction coefficient and the performances on a humid conductor. A metallic additive may be incorporated to the mix to improve the electrical conductivity. Finally, a tooth pulley 4*c* is mounted solidly to the arm 4*d* of the traction wheel that will be motorized via a tooth belt 16 and a motor 17 dedicated to each wheel 4, as illustrated in FIGS. 12*a* and 12*b*.

The attachment means 15 may have a security roller system, as shown in FIG. 12*a* in close position and in FIG. 12*b* in open position. This system is composed of two fingers 15*a* each holding a roller 15*b* mounted in an overhanging manner by bearings and which pivot around axis 15*c* parallel between themselves and with respect to the conductor 2. These fingers 15*a* are each connected to a worm gear but one of the worm gears is threaded to the left 15*d* while the other is threaded to the right (not shown). A motorized shaft 15*f* driven by an electric motor 15*g*, is positioned simultaneously above both gears by juxtaposing to them the worms with corresponding thread. Thereby, a rotation of the shaft 15*f* in one direction will cause the simultaneous opening of the fingers 15*a* while the opposite direction will carry out their closing. The axes 15*c* are placed slightly over the conductor 2 and the fingers 15*a* have a shape that ensures that the rollers 15*b* come in contact with the conductor 2 underneath it. By choosing a step that is small enough with respect to the diameter of the worms (helix angle) one achieves a non reversible system (auto-blocking), which ensures reliability of the hold under the conductor 2.

With respect to the motorization of the arms 12, only the proximal part 12*a* is directly connected to the transmission shaft 11 by means of a system of grooved plates 18 of which the functioning will be further explained below. The proximal arm 12*a* has the possibility to move on 180 degrees, being completely vertical upwards when the wheels 4 are on the conductor 2 and completely vertical but downwards when the wheels 4 are removed from the conductor 2.

The coordination of the movement of rotation of the distal part 12*b* of the arms 12 with that of the proximal part 12*a* of the arms 12, illustrated by FIGS. 13, 14*a*, 14*b* and 14*c*, is achieved by a system of pulleys and of toothed belts 19. One finds, indeed, two toothed pulleys 19*a* having given diameter D1 which are mounted in solidarity with the rectangular tubular frame 7 so as to be coaxial with respect to the rotation shaft 11 but without being fixed to it in any way. One also finds two other toothed pulleys 19*b* of a diameter slightly greater D2 that are mounted in and interdependent manner with the distal arms 12*b*, in a coaxial manner with respect to the intermediate pivot. These two pulleys 19*b* are linked to one another by a toothed belt 19*c*, which tension is maintained by a tensioner (not shown).

The rotation of the proximal arms 12*a* of a certain angle $\psi$ then produces the rotation of the distal arms 12*b* of a measured angle with respect to the tubular structure 7 given by $(D2/D1-1)\times\psi$. Therefore, in a preferred configuration, one has chosen diameter values corresponding to D2=44 teeth, D1=34 teeth in order to have an angle of the wheels equal to 41 degrees when the proximal arms 12*a* are turned by 180 degrees.

Figure 14A:
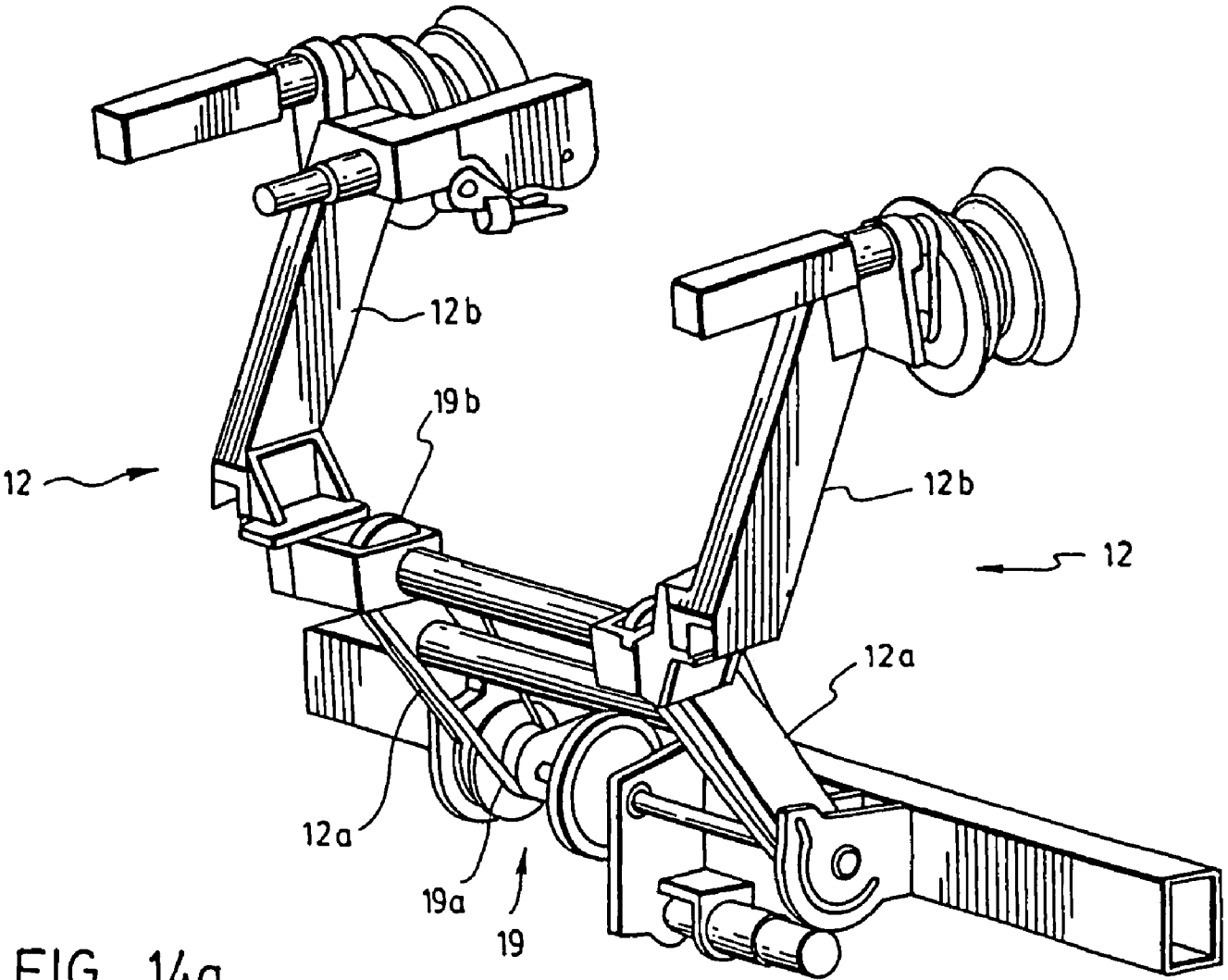
FIGS. 14*a*, 14*b* and 14*c* are perspective views of the part of the vehicle shown at FIG. 9 illustrating a sequence of clearing of the wheels.
Figure 14B:
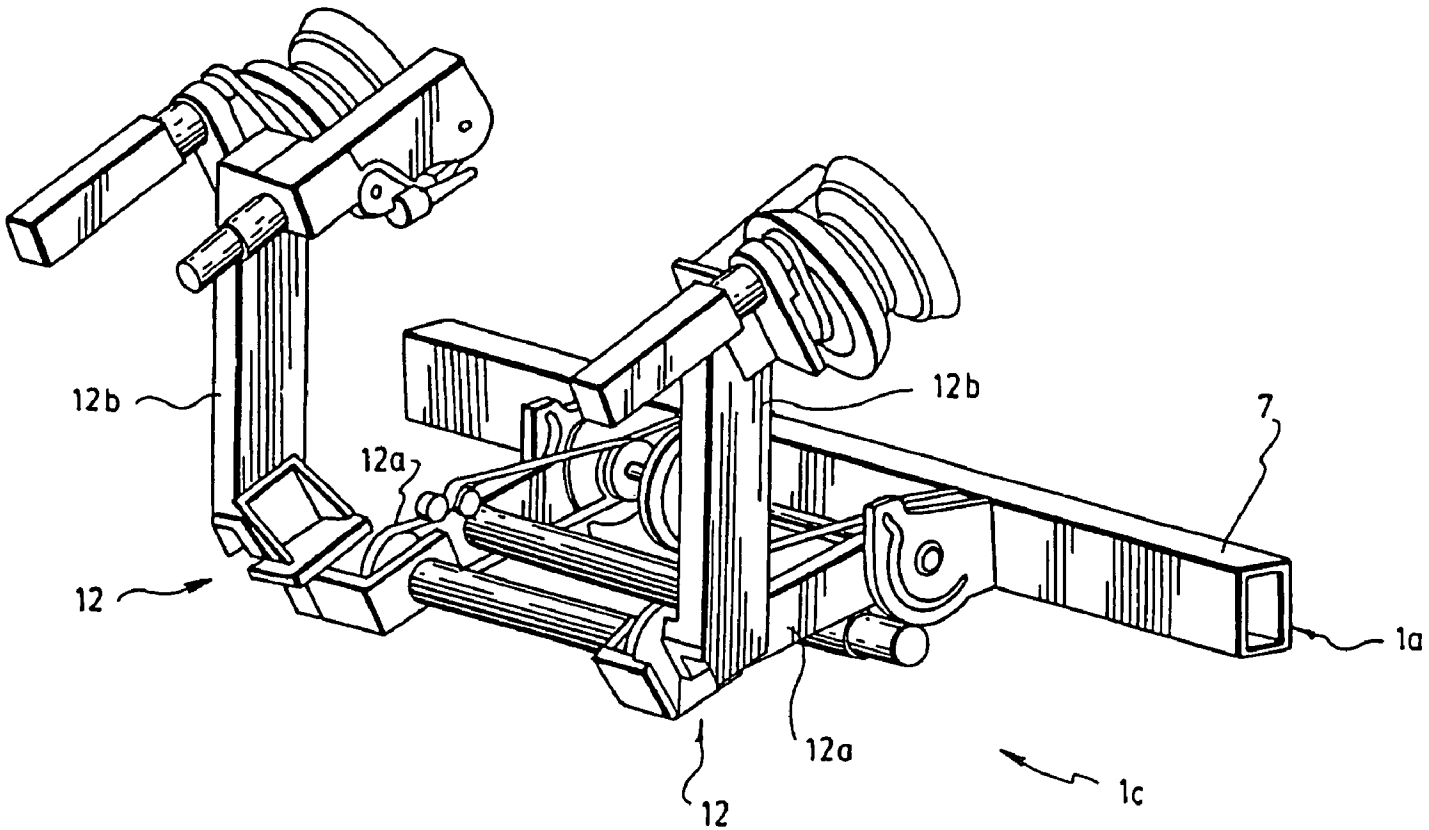
Figure 14C:
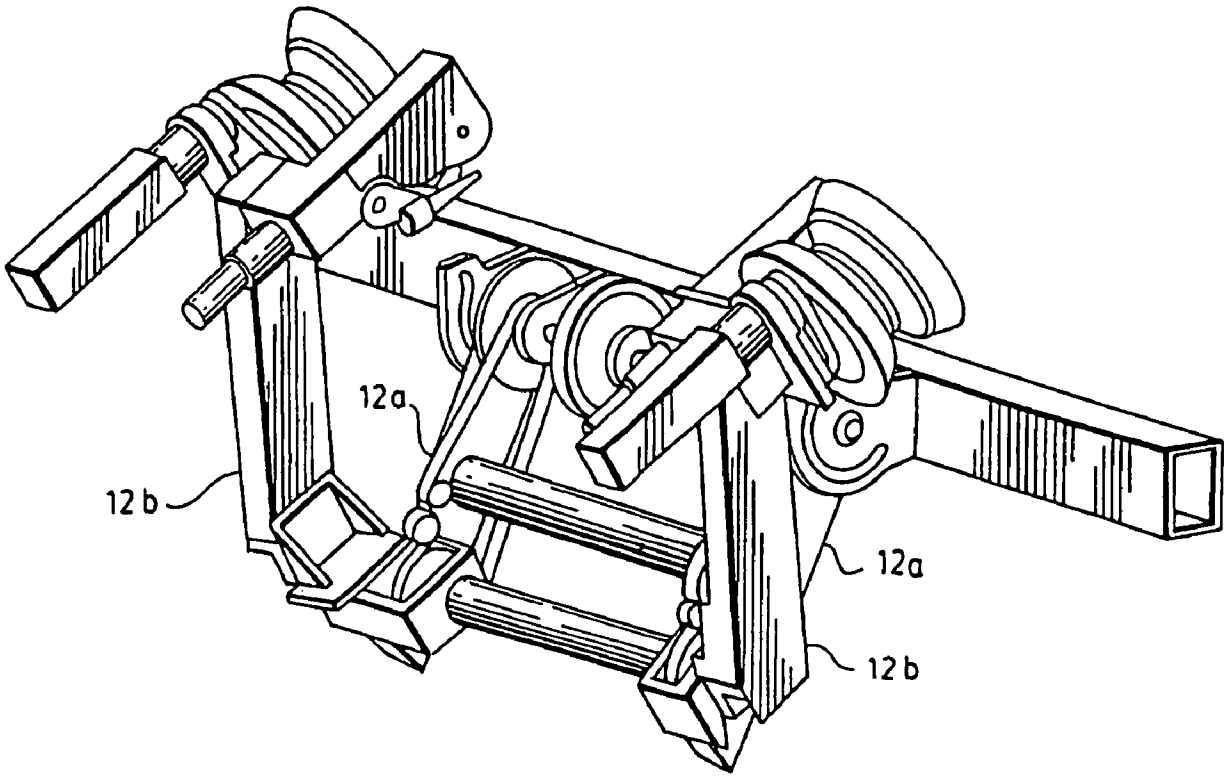

FIGS. 14*a*, 14*b* and 14*c* show in three steps the complete release of the wheels 4 that is obtained with this gear ratio. The system ensures a compact position of the arms 12 when the wheels are disengaged and the proximal arm 12*a* is downwards. The system minimizes the visible displacement of the global center of gravity while the arms 12 are moving up and allows approaching the conductor 2 with an almost horizontal final direction.

The motor for releasing the wheels 11*b* and its gear box are obviously dimensioned to support the moment of force generated when the arm 12 is moved up, while the vehicle 1 rests on the clamps 23 used as temporary supports. However, in order to minimize the weight and the dimensions of these components, it is not reasonable to give those dimensions so that they could also support the moment generated around the same axis of the transmission shaft 11 when the vehicle 1 as a whole is supported by the traction wheels 4, this moment being about seven times greater.

Lets resume the description of the system of grooved plates 18 which enables the mechanical link between the axis of the transmission shaft 11 and the proximal arms 12*a* while they are going up or down but which release the arms 12 and the shaft 11 once these have achieved their high vertical position, before the transfer of the weight of the vehicle from the support clamps 23 towards the wheels 4.

Figure 15A:
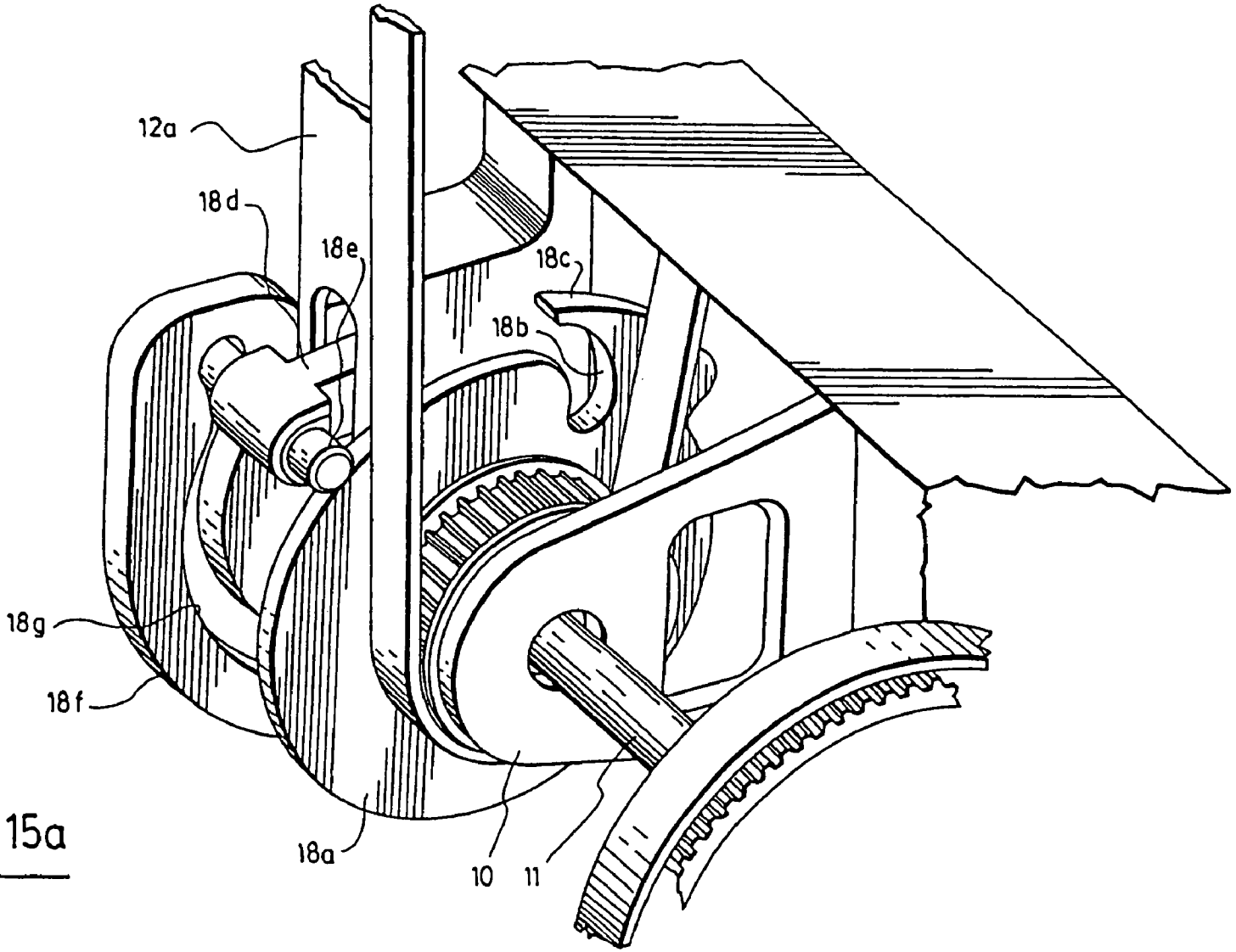
FIGS. 15*a*, 15*b* and 15*c* are detailed views of a system for disengagement of the shaft of the wheels of the vehicle shown at FIG. 5.
Figure 15B:
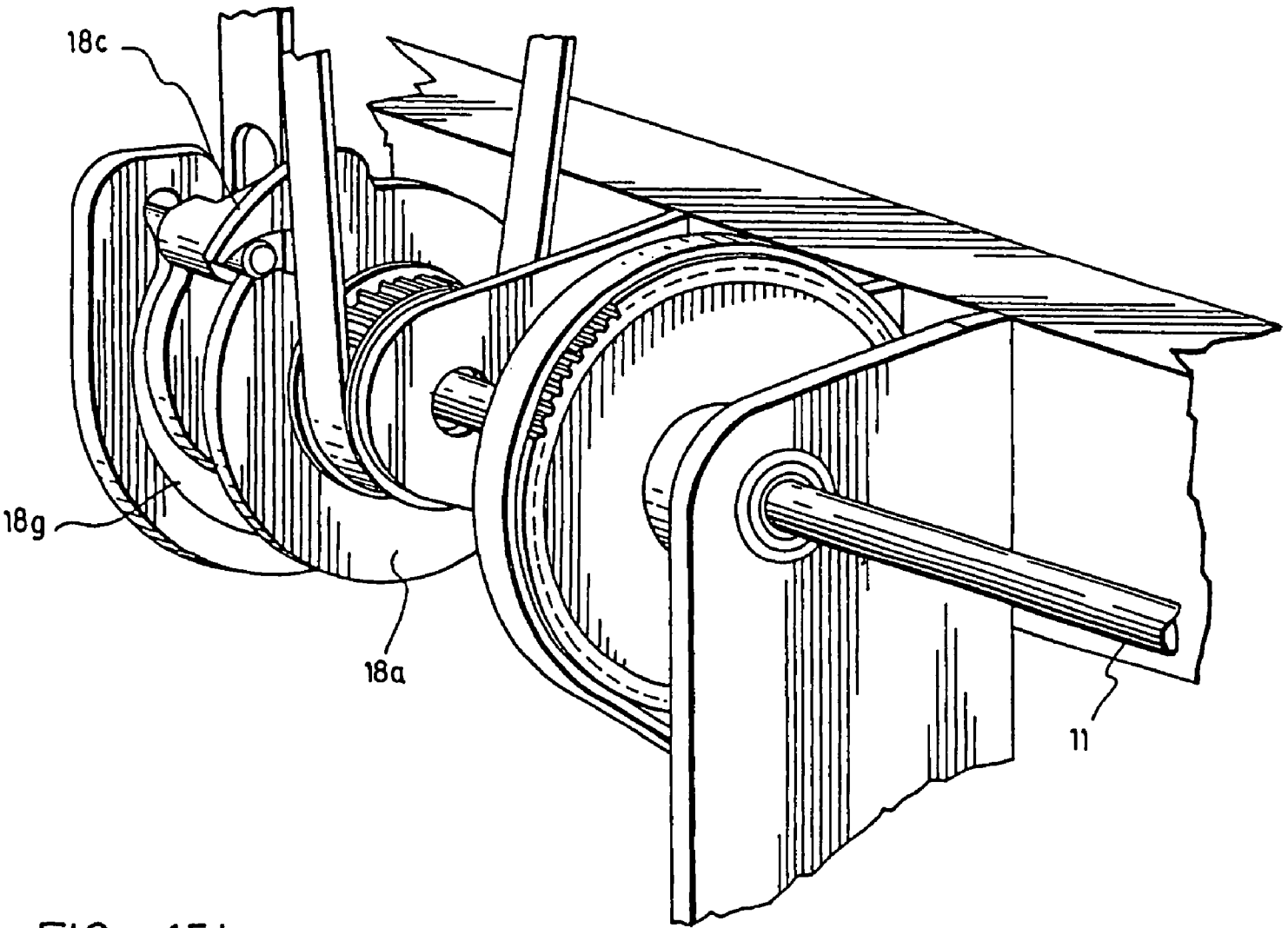
Figure 15C:
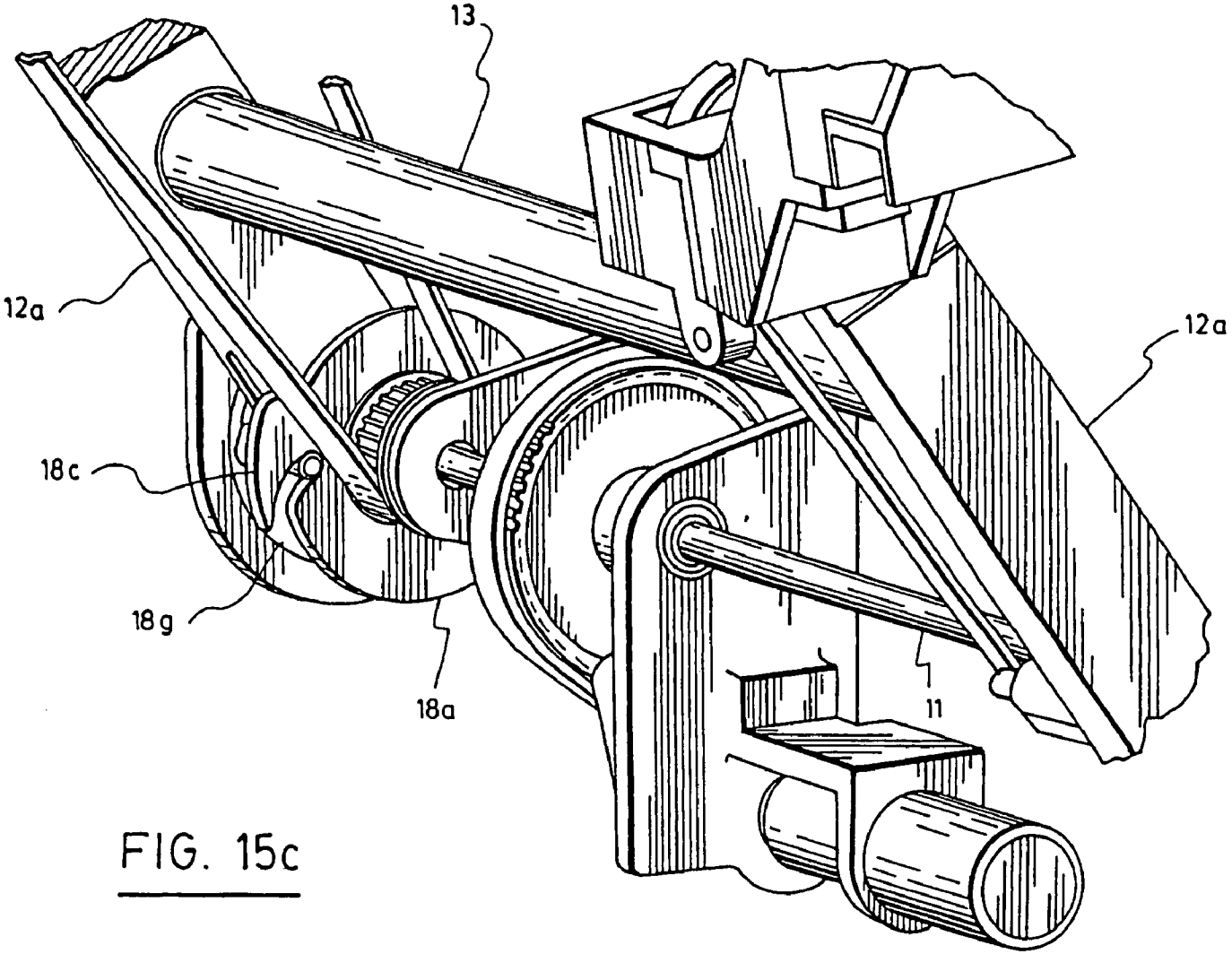

Referring to FIGS. 15*a*, 15*b* and 15*c*, the engagement plate 18*a* which has the shape of a disk of a certain diameter and provided with a groove 18*b* that goes down to a diameter that is slightly inferior in a direction that is slightly inclined with respect to the radius of the disk. This groove 18*b* is topped with an engagement tooth 18*c*. The disk is solidly connected in an interdependent manner to the transmission shaft 11.

The proximal arm 12*a* bears a rigid link 18*d* mounted on a pivot parallel to the shaft 11 and that ends with a pin 18*e* inserted by tightening and whose length is sufficient so that it joins on one side the engagement plate 18*a* and on the other side, a locking plate 18*f*.

This locking plate 18*f* is connected in an interdependent manner to a rectangular tubular section 7. This plate 18*f* has a circumferential groove 18*g* of about 180 degrees. The circumferential groove 18*g* of the locking plate 18*f* is also ended with a straight groove segment slightly inclined with respect to a radius but this one goes away from the center.

Therefore, according to this configuration, the pin 18*e* inserted in the rigid link 18*d* can only be located in two radial positions: 1. Removed from the center, at the bottom of the straight groove of the locking plate 18*f* and it cannot go out because it is stock therein by the exterior diameter of the disk of the engagement plate 18*a;* 2. Close to the center when it is at the bottom of the straight groove of the engagement plate 18*a* and is constrained to turn with this one. The pin 18*e* is free to do it because it slides in the circumferential groove of the locking plate 18*f*. The transition between both positions is achieved in one direction or the other by the rotation of the engagement disk. FIGS. 15*a*, 15*b* and 15*c* show three positions of this transition.

Figure 16:
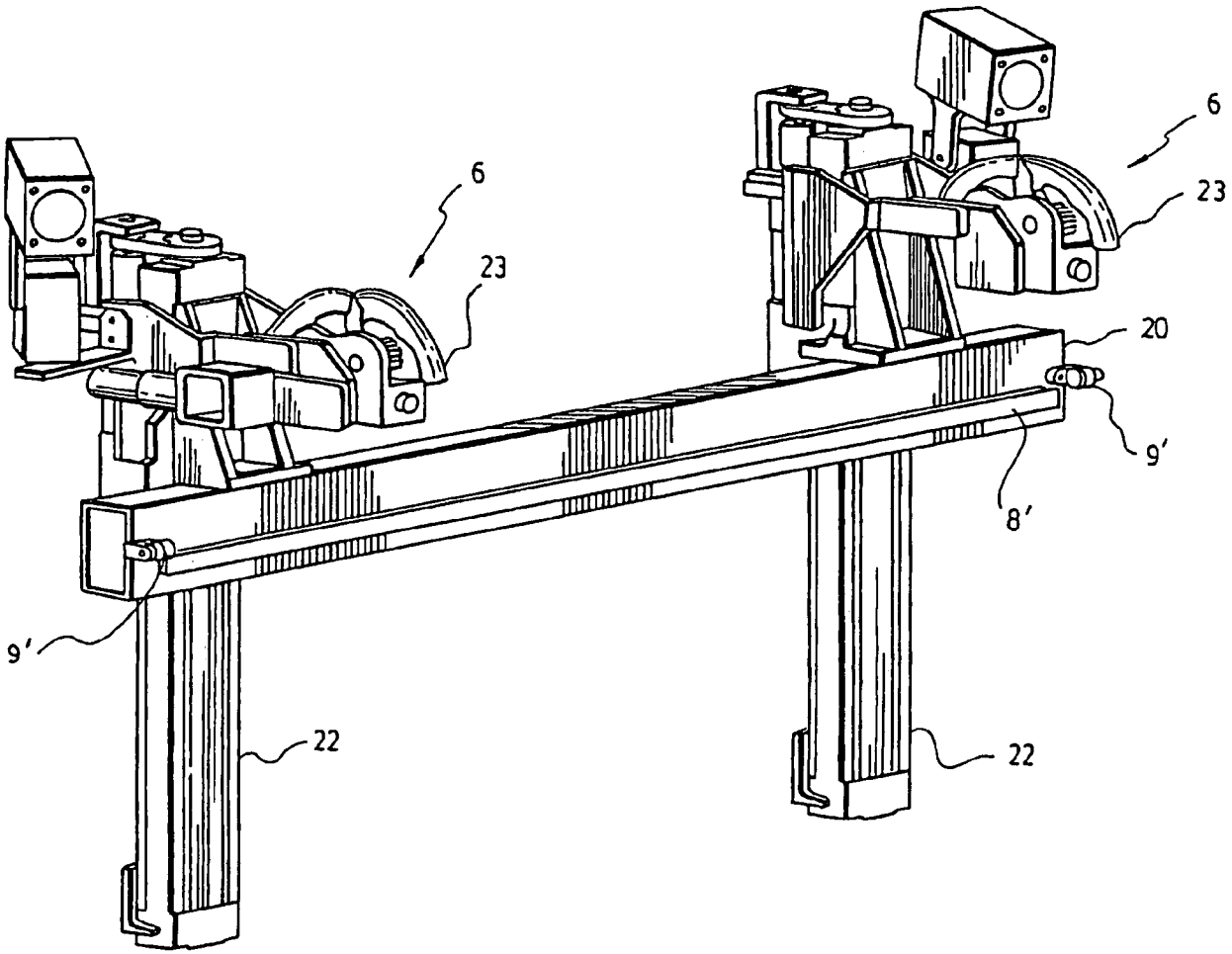
FIG. 16 is a perspective view of a part of the vehicle shown at FIG. 5 illustrating a second frame that can be moved longitudinally with respect to the first frame holding the holders.

Referring to FIG. 16, the second frame 20 also has a rectangular tubular structure which supports a rail 8' identical to the one of the first frame 7 and that is used to guide the translation of the first and second frames 7 and 20. There are two mechanical stoppers 9' at the extremities of the rail 8' for limiting the translation movement.

The second frame 20 supports by means of squares 21 two temporary support arms 22 of vertical translation and longitudinally spaced one with respect to the other. Each of the two temporary support arms 22 support the holding means 6 of the support 2 which is used as a temporary support for the vehicle 1. Preferably, both temporary support arms 22 are positioned symmetrically with respect to the center of the second frame 20 and are positioned at a sufficient distance one with respect to the other to allow to place each holding means 6 of the support 2 on each side of the largest obstacle considered.

Figure 17:
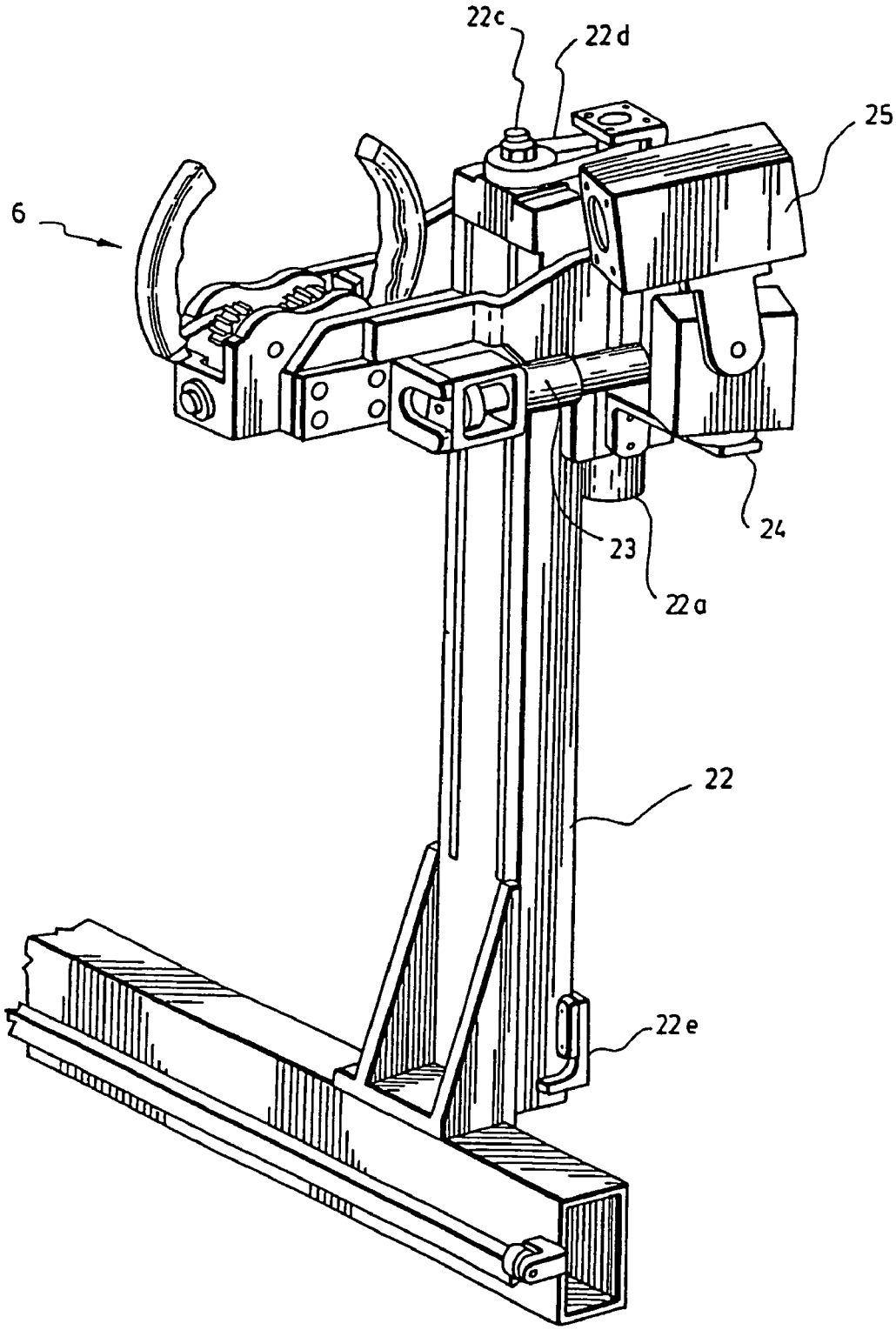
FIG. 17 is a more detailed perspective view of a translation block of the holders shown at FIG. 16.

Both temporary translation support arms 22, shown in their high configuration on FIG. 17, each support a holding means 6 and a support platform 24 for an adjustable camera 25. The holding means 6 may be a motorized clamps mechanism, as explained below. The temporary translation support arms 22 are also motorized independently by a motor 22*a* and a translation belt 22*b*. The principle of operation is based on the use of a worm with a central ball 22*c* which generates the movement when it is rotated and of a system of parallel rails which ensures a good rigidity to the set. It is to be noted that each temporary translation support arm is a commercially available product, and that the internal details are not shown. Mechanical stoppers 22*e* limit the translation movement.

Figure 18:
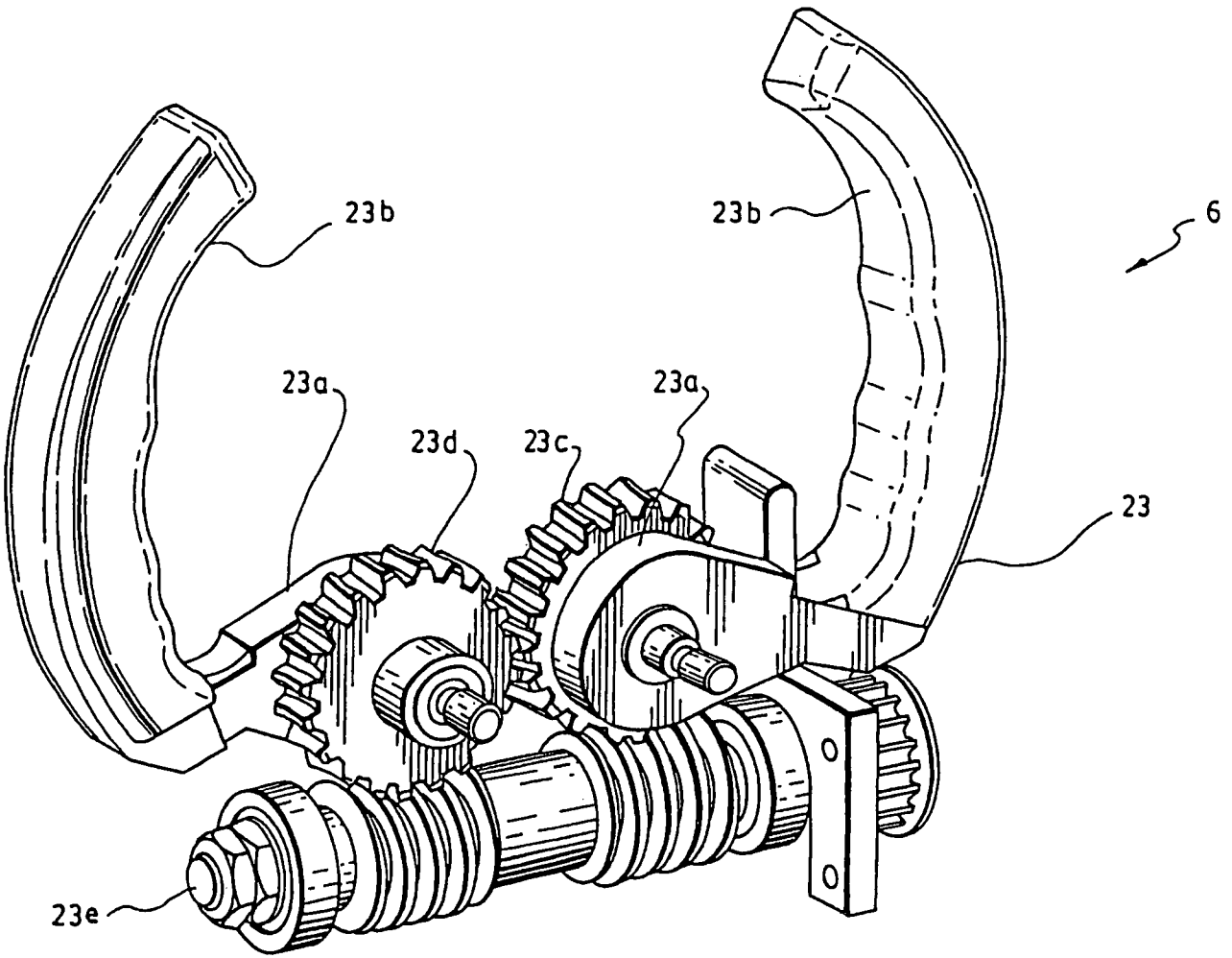
FIG. 18 is a more detailed perspective view of a temporary holding system shown at FIG. 16.

The holding means 6 of the support 2, of which a preferred embodiment is shown without a frame for better clarity at FIG. 18, operates on a principle identical to the one of the security rollers 15 of the attachment means described above. A motor 23 activates a transmission shaft 23*e*, by means of a belt (not illustrated) that has a threaded worm threaded to the right and a threaded worm threaded to the left. These worms are each geared to a worm gear 23*c*, 23*d* linked to a member in the shape of an arc of a circle 23*a* and that is mounted on a pivot. This member is covered with a sheath 23*b* made of rubber, of polyurethane or of another material which increases the friction coefficient between this one and the conductor. The rotation of the shaft thus brings about the simultaneous closing or opening of the members. The system is also self-blocking. Of course, any other system of clamps achieving the same function may be used.

Figure 19:
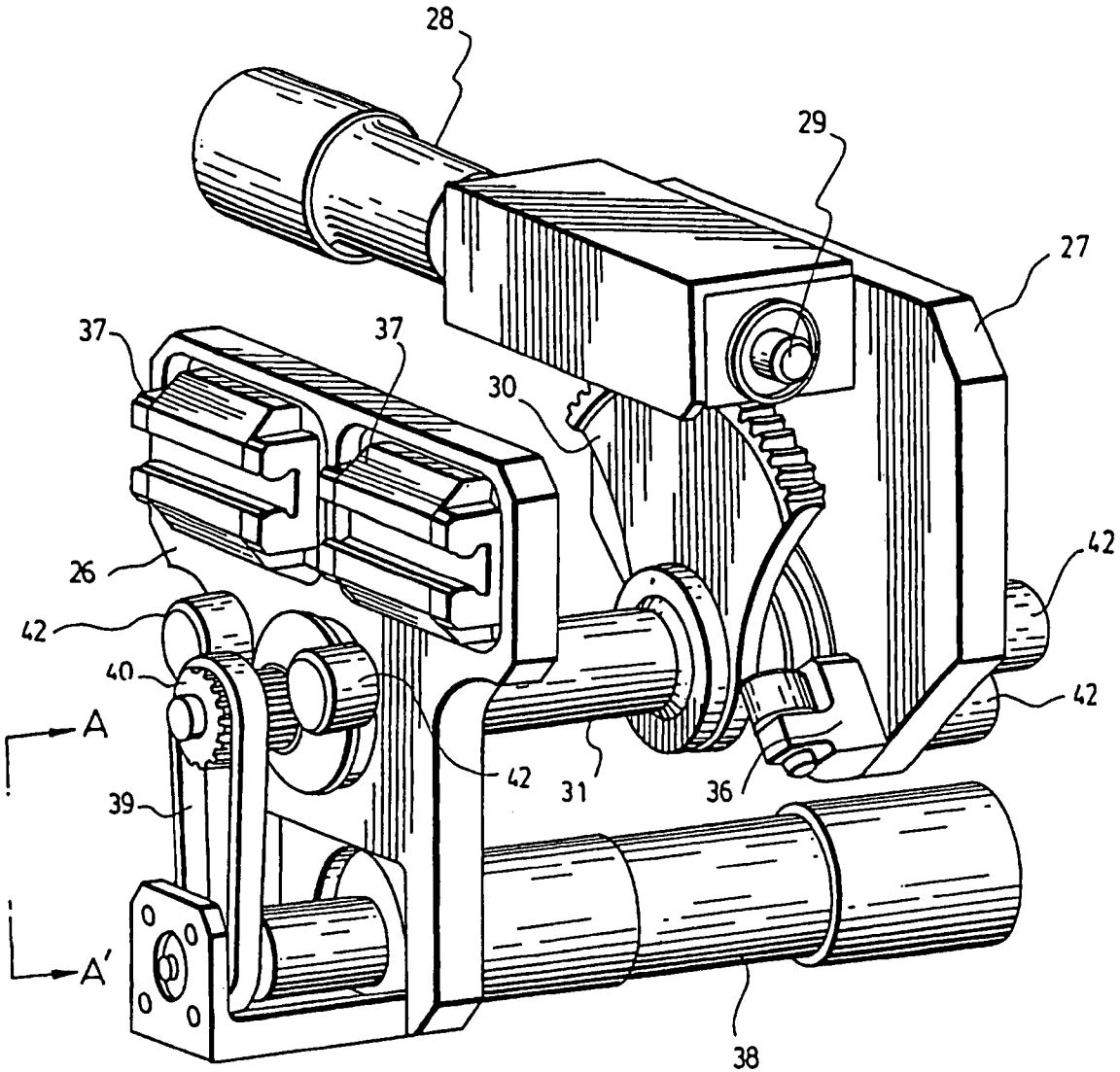
FIG. 19 is a more detailed perspective view of certain elements of the vehicle shown at FIG. 5.
Figure 20:
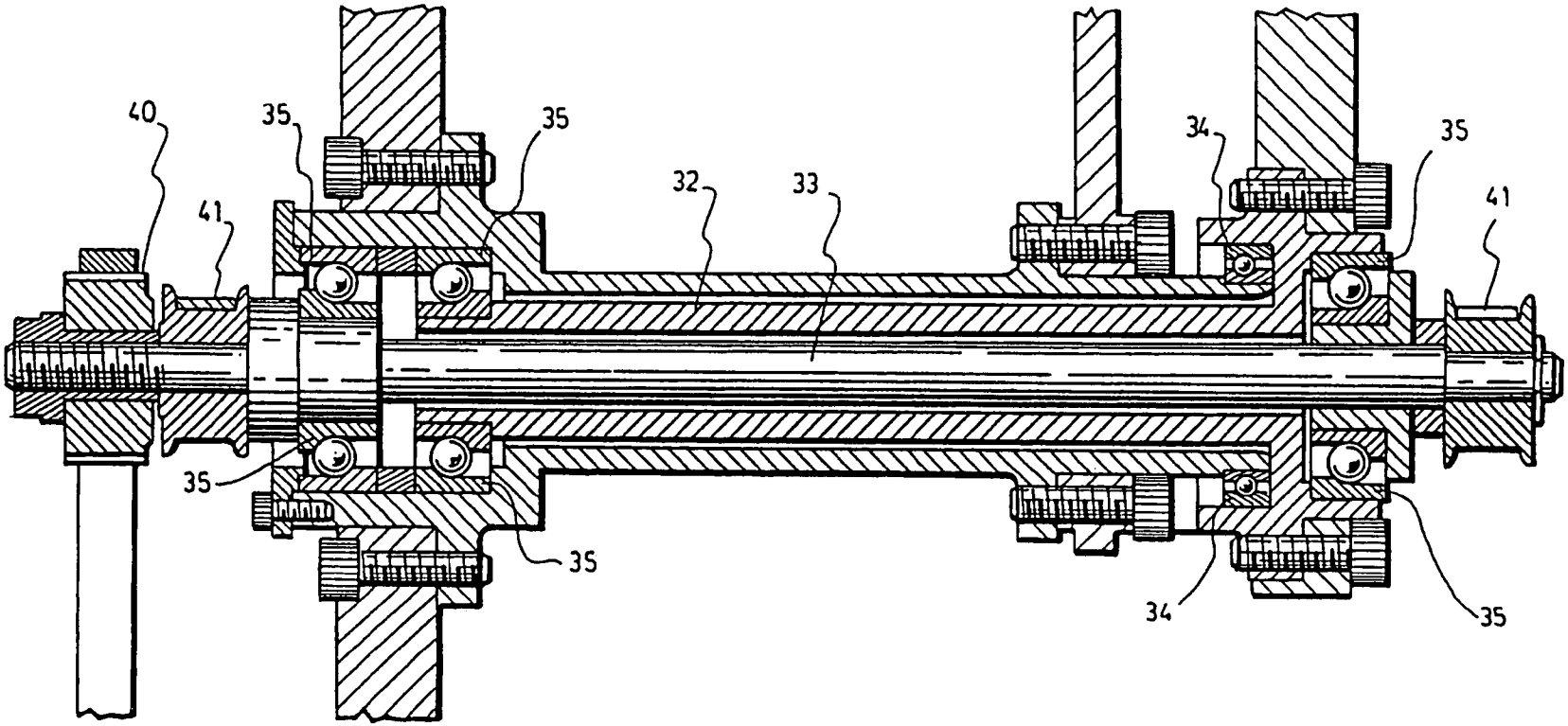
FIG. 20 is a section view along line A-A' shown at FIG. 19.
Figure 21:
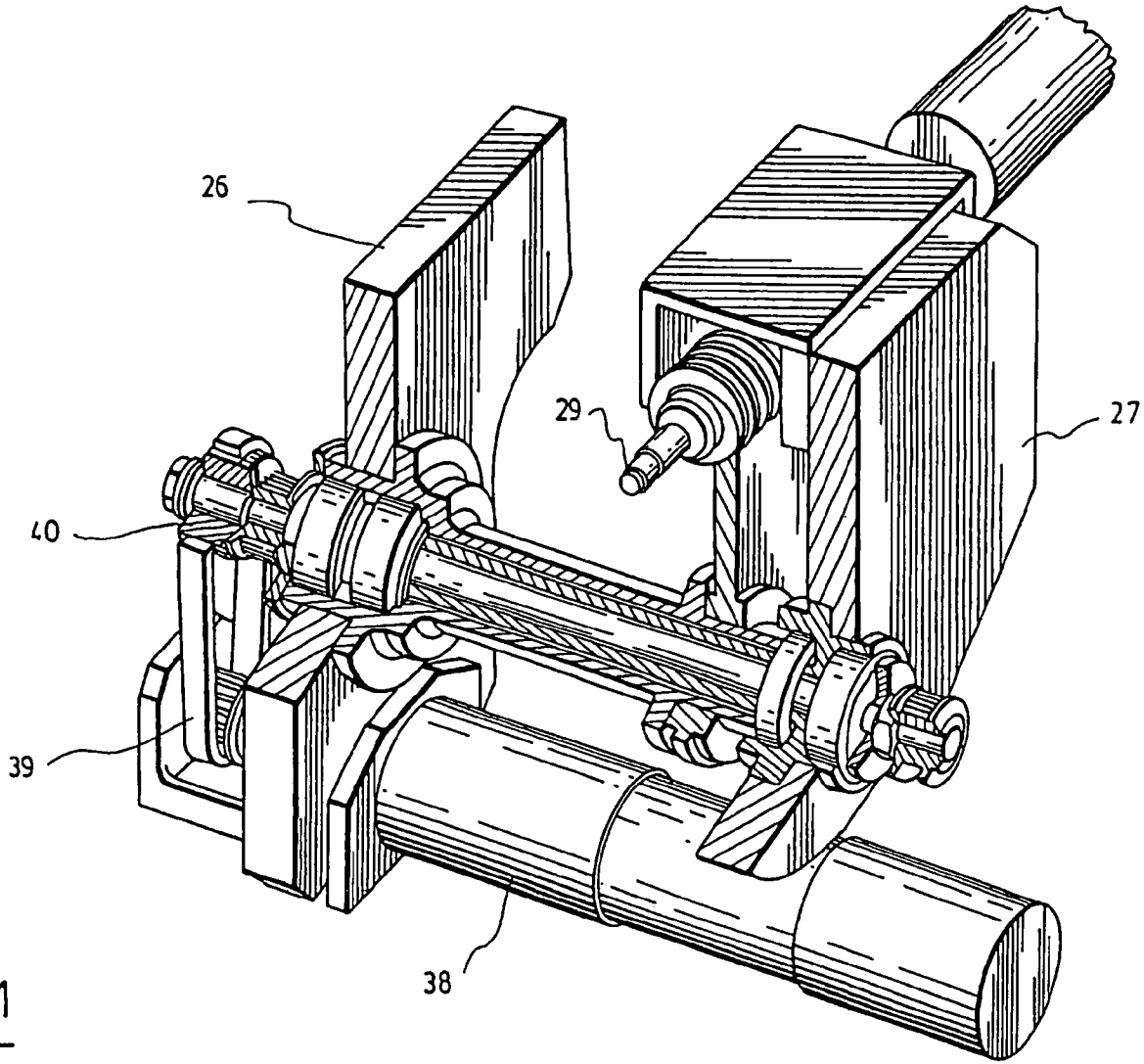
FIG. 21 is a perspective partially in section view of certain elements of the vehicle shown at FIG. 5.
Figure 22A:
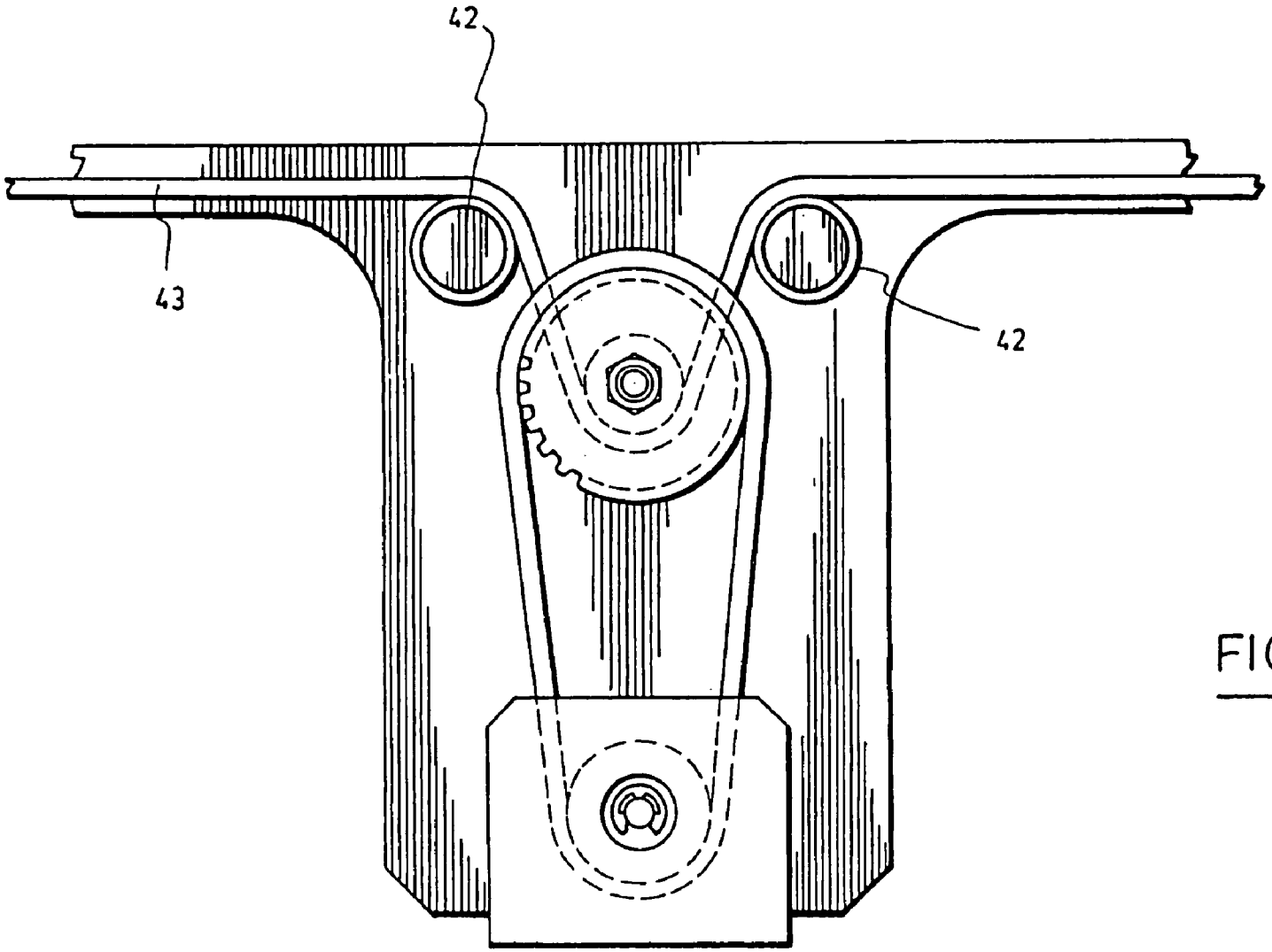
FIGS. 22*a* and 22*b* are more detailed perspective views of the drive belts used for the displacement of the frames of the vehicle shown at FIG. 5.
Figure 22B:
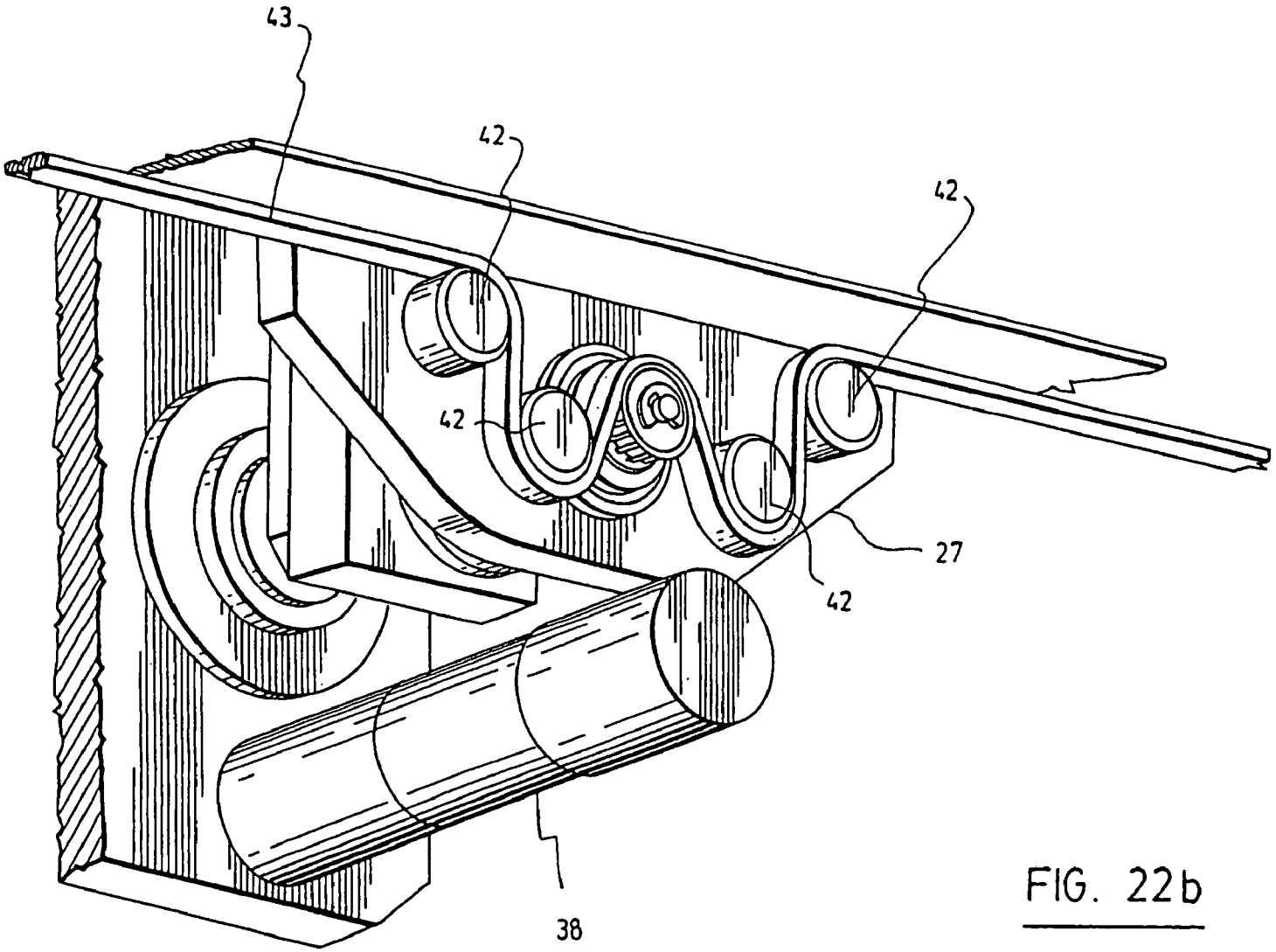

Referring to FIGS. 19 to 22, there is shown the details of a central structure of the vehicle 1 that ensures the link between the first and second frames 7, 20. Furthermore, both functions of the central structure are to generate the relative rotation between these two frames 7, 20 and to produce their simultaneous translation but in opposite directions. It is preferable in order to obtain better performances to concentrate the greatest fraction of the possible weight in this sub-system. FIG. 19 shows an isolated view of the central structure and FIG. 21 completes the visual description by showing the interior of the system.

There is shown the support plate 26 of the second frame 20 and the support plate 27 of the first frame 7. A motor 28 responsible for the rotation of the frames 7, 20, rigidly mounted on the back of a second frame, operates a worm 29 which gears to a sector of a worm gear 30 that is mounted in an interdependent manner to the exterior shaft 31 of a trio of concentric shafts, of which there is shown a longitudinal cross section at FIG. 20. This cross section allows noticing that the intermediate shaft 32 is linked in an interdependent manner to the support plate 26 of the second frame 20. These two shafts 31, 32 are separated by a roller bearing 34 and an angular contact bearing 35. These further jointly support the central shaft 33 by means of angular contact bearings 35 that ensures the axial rigidity of the set. Mechanical stoppers 36 are located on the support plate 27 of the first frame 20 on each side of the worm gear sector for limiting the angular movement of the frames. Each of the support plates 26, 27 carries two translation carts 37 having a low friction coefficient. These carts 37 are obviously of the type corresponding to the rails ensuring the translation of the frames and are therefore able to support all the combinations of moment of force.

A motor 38, responsible for the translation of the frames 7, 20, is mounted at the bottom of the support plate 26 of the second frame 20. This motor 38 drives the central shaft via a belt 39 and a toothed pinion 40 placed at the extremity of the shaft 31. Two other pinions 41, which have the same number of teeth between them, are placed on this shaft 31, one on each of the sides of the support plates 26, 27. These pinions 41, in conjunction with passive rollers 42 of which there are two on the side of the second frame 20 and of which there are four on the side of the first frame 7, are being wrapped around by slotted linear belts 43 which are strained below the rectangular tubes and it is this system that is responsible for the translation of the frames. Since one of the belts is wrapped below the pinion of the shaft and the other above, a rotation of the central shaft in one direction will cause translations in the opposite directions. This translation system, particularly light with respect to the allowed translation length, is also very permissive with respect to the assembling precision.

Figure 23:
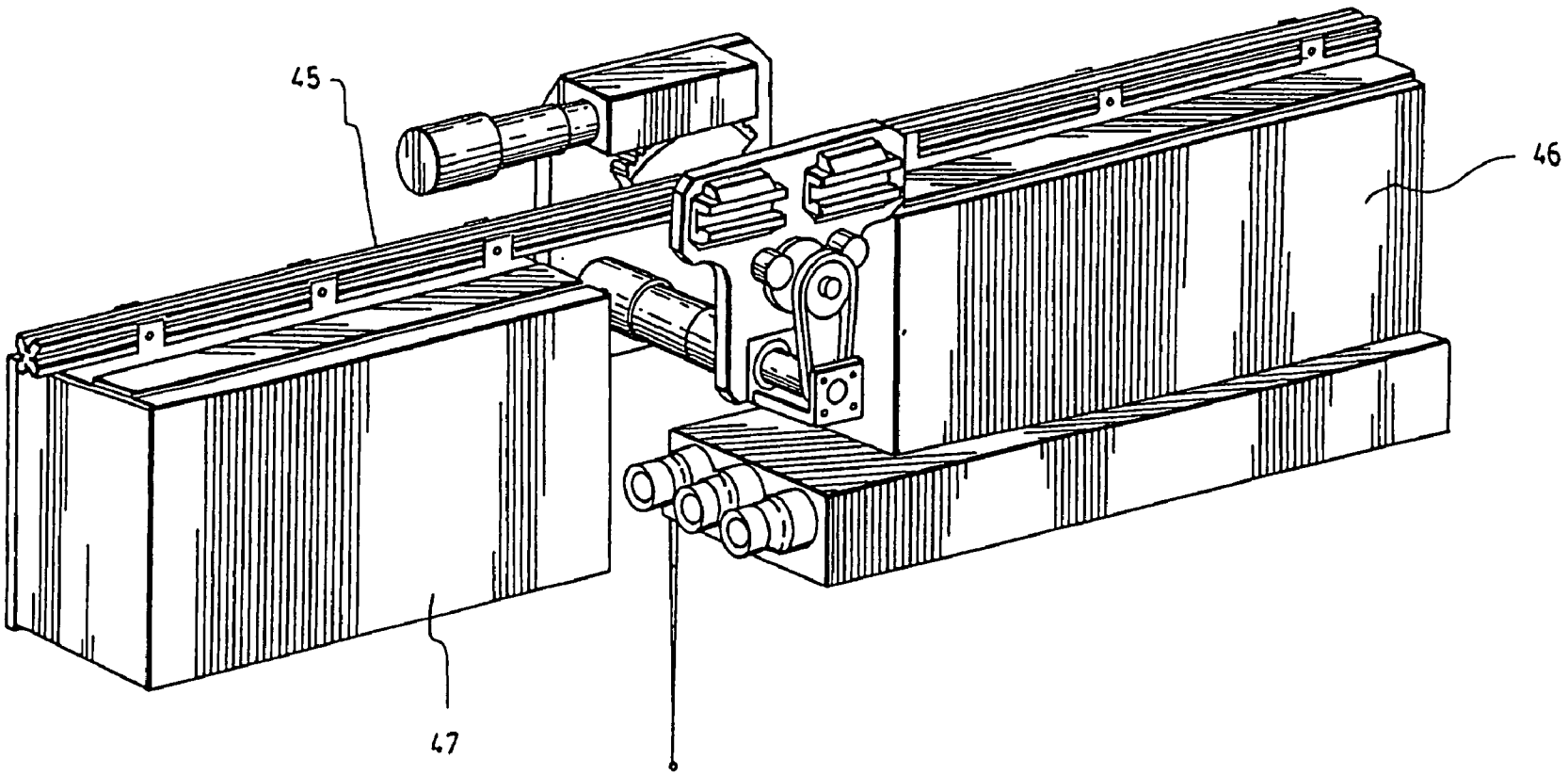
FIG. 23 is a more detailed perspective view of the peripheral systems of the vehicle shown at FIG. 5.

Referring to FIG. 23, a longitudinal bar 45 is mounted at its center on the external shaft 31 and is destined to support an electronic control box 46 and a battery box 47. The first of the boxes therefore contain the radio transmission elements for the data and video, the electronic control cards of the motors, the information return systems such as inclinometers. It is therefore from this box that will come out three braids of wires for powering and receiving the information of the three principle parts of the vehicle. The exact path followed by these wires is not described herein as it may depend on the number of wires used and of their destination. It is however preferable to avoid overcrowding the passage of the different mobile pieces of the system.

Possible Variants

The vehicle may have only one motorized traction wheel present with a system of security rolls on each side for stabilizing the set.

It is possible to eliminate the rotation axis of the frames 7, 20 as it constitute a degree of freedom that is redundant and that adds to the versatility of the concept but may prove to be non essential for some obstacles 3.

It is possible to combine the motorization of certain systems. Thereby, one can easily use only one motor where there are two. For example, for the traction wheels, the security rollers, the temporary support arms and the holding means (height and closure).

It is possible to close the security rollers by means of a spring a torsion spring or other, allowing a certain adaptability to the encountered obstacles when the vehicle rolls with its rollers closed, for example on jointing sleeves.

It is possible to arrange things so that the holding means lays down on the top of the conductor instead of arriving from underneath, which would be advantageous or more versatile for certain types of obstacles, but would add to the complexity of the vertical translation blocks.

It is possible that each of the holding means 6 be mounted on a distinct frame and would thereby achieve a translation or rotation movement independently one with respect to the other.

It is possible to arrange things so that the motored wheels 4 be mounted on distinct structures which would allow their disengagement of the conductor independently from one another.

Intended Applications

The vehicle is destined to be installed and to move on a cable in order to transport different sensors, including cameras, for the inspection or the maintenance of energy transport components.

This vehicle completes the family of small remote control vehicles destined to the inspection of aerial conductors because it has as characteristic to be able to clear obstacles that are present on the transport networks, notably the vibration dampers, the suspension clamps and the insulator strings present at pylons as well as aerial markers, which may be of a cylindrical or spherical shape.

Further to the inspection, the dimensions and the robustness of the mobile elements of the vehicle allow it to be equipped with true tools thereby to achieve real interventions on the components located in its proximity. One can think for example to the repairing (temporary or not) of broken strands, the automated soldering of the structures, the painting or the cleaning of components. Furthermore, certain mobile elements inherent to the vehicle (such as temporary supports) may be already used as positioning arms that are precise enough for a plurality of existing sensors but that otherwise stumble on the challenge of approaching the interest zone.

The installation of this vehicle may therefore be done in a zone easily accessible, close to a road for example, and then it can be sent on several areas, which will allow it to document a section of the network otherwise difficult to have access to, in a manner of a scout.

The proposed vehicle allows circulating on a cable of different diameters, which can be under live electrical conditions or not. Thereby, any guy wires, such as those of telecommunication towers, the motor cables of chair lifts (or of gondola lifts or cable cars, etc.) may potentially be traveled by the vehicle according to the invention. Furthermore, the vehicle may circulate on one of the cables of a bundle of cables, which can be double, triple or quadruple.

Complements to the Principle and Advantages

From a strictly conceptual point of view, the proposed principle is probably the simplest, the fastest and the more reliable that could be contemplated. For this reason, once mechanically achieved, it is probable that it will generate the most compact vehicle and the lightest one that can be obtained for an obstacle of a given length.

The presence of an obstacle on the conductor implies that there is a discontinuity and that the vehicle to conceive has to change its way of moving for transferring itself, after it clears the obstacle, completely on the other side of the obstacle.

The proposed principle minimizes the number of steps needed by using a single intermediate hold, which is located on both sides of the obstacle. The complete transfer of the vehicle is therefore achieved in a single step.

Any other way of to clear the obstacles, which would imply a transfer in several steps, such as the one using intermediate wheels that would settled one after the other following on from the obstacle, seems therefore more complex, slower and would require a vehicle with larger overall dimensions.

The previous point has for consequence that it is very easy to ensure the reliability of the vehicle: a single criterion is to be verified to avoid any possible fall and it is to make sure to have at all times a minimum of two supports locked on the conductor. There is no exception, there is no particular case and each obstacle may be cleared according to the same sequence of operation.

An important element of the concept remains to be explained. The wheels frame and the frame of the temporary support are linked to one another by a central structure. The relative translation of the frames is therefore achieved through this central structure, which itself supports most of the mass of the vehicle such as the batteries and the telecommunication and control box. This allows two distinct advantages.

The first of the advantages is to multiply the length of the movement of translation for a given overall length. Indeed, the central structure is the one at the origin of the translation movement and generates two opposite movements for each of the lateral frames, which doubles the total effective translation.

Figure 4:
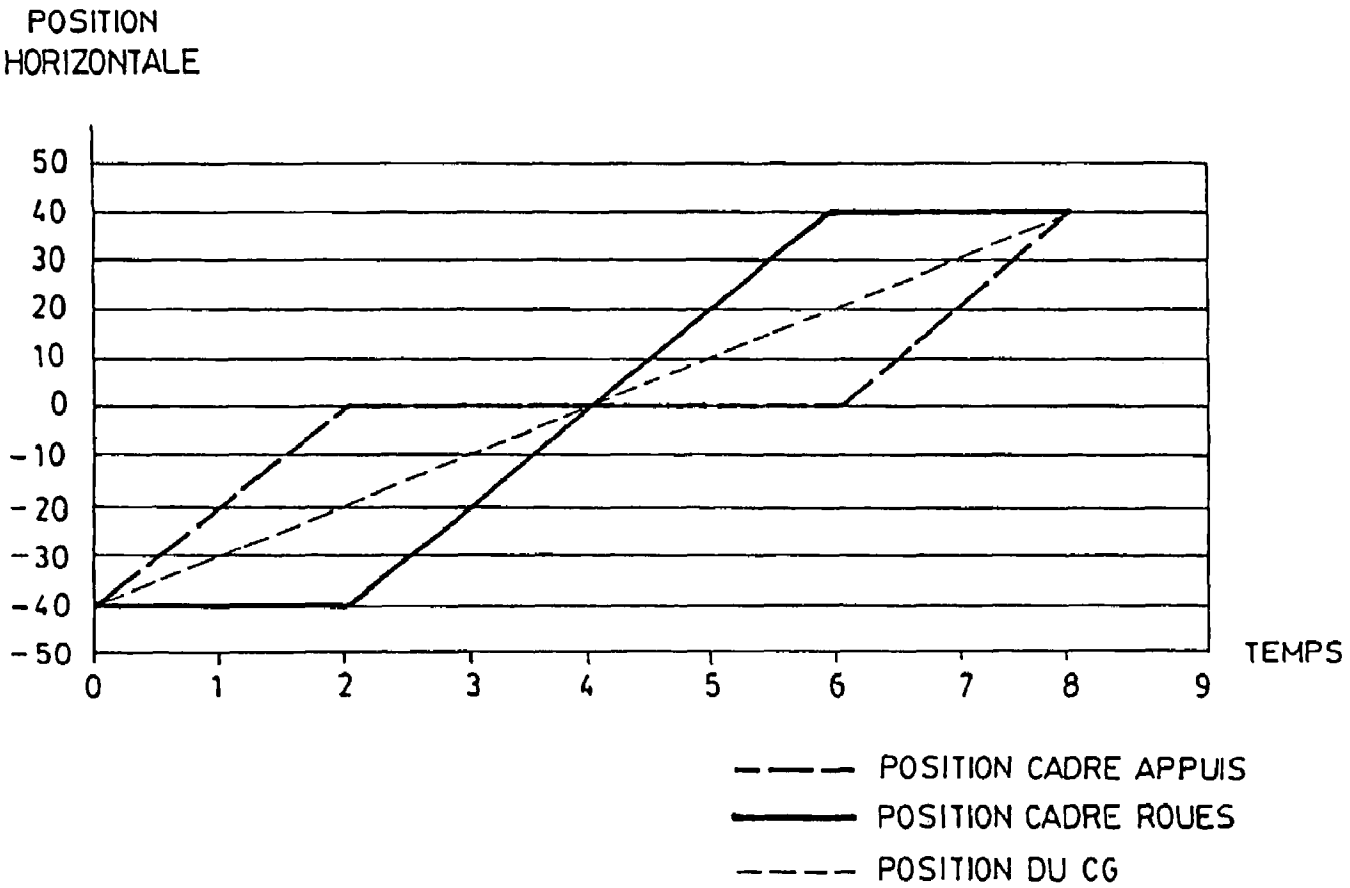
FIG. 4 shows curves representing the position of the support frame, of the wheel frame and of the CG as a function of time while clearing a warning marker according to a preferred embodiment of the present invention.
Figure 5:
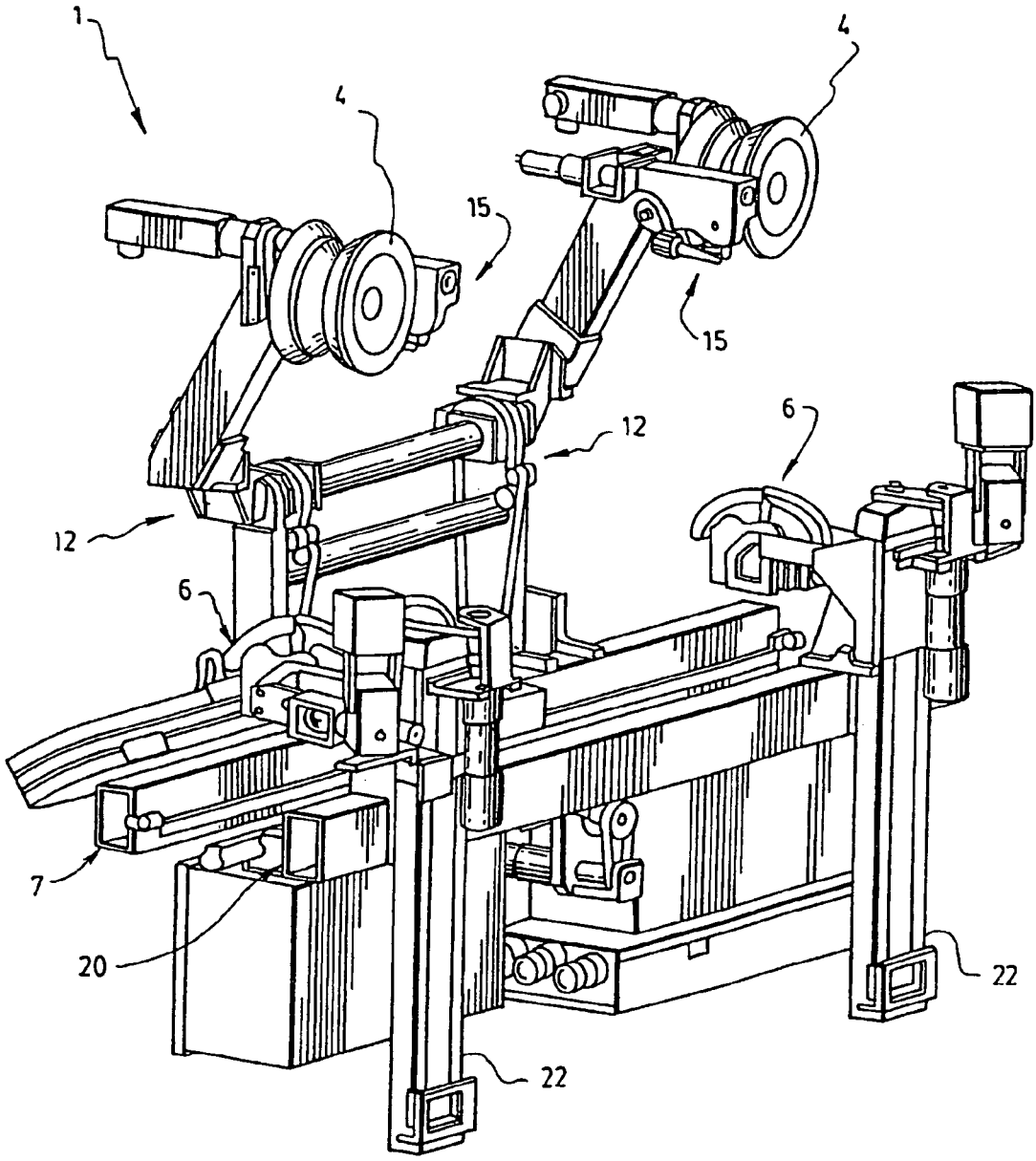
FIG. 5 is a perspective view of a vehicle according to a preferred embodiment of the present invention.
Figure 6:
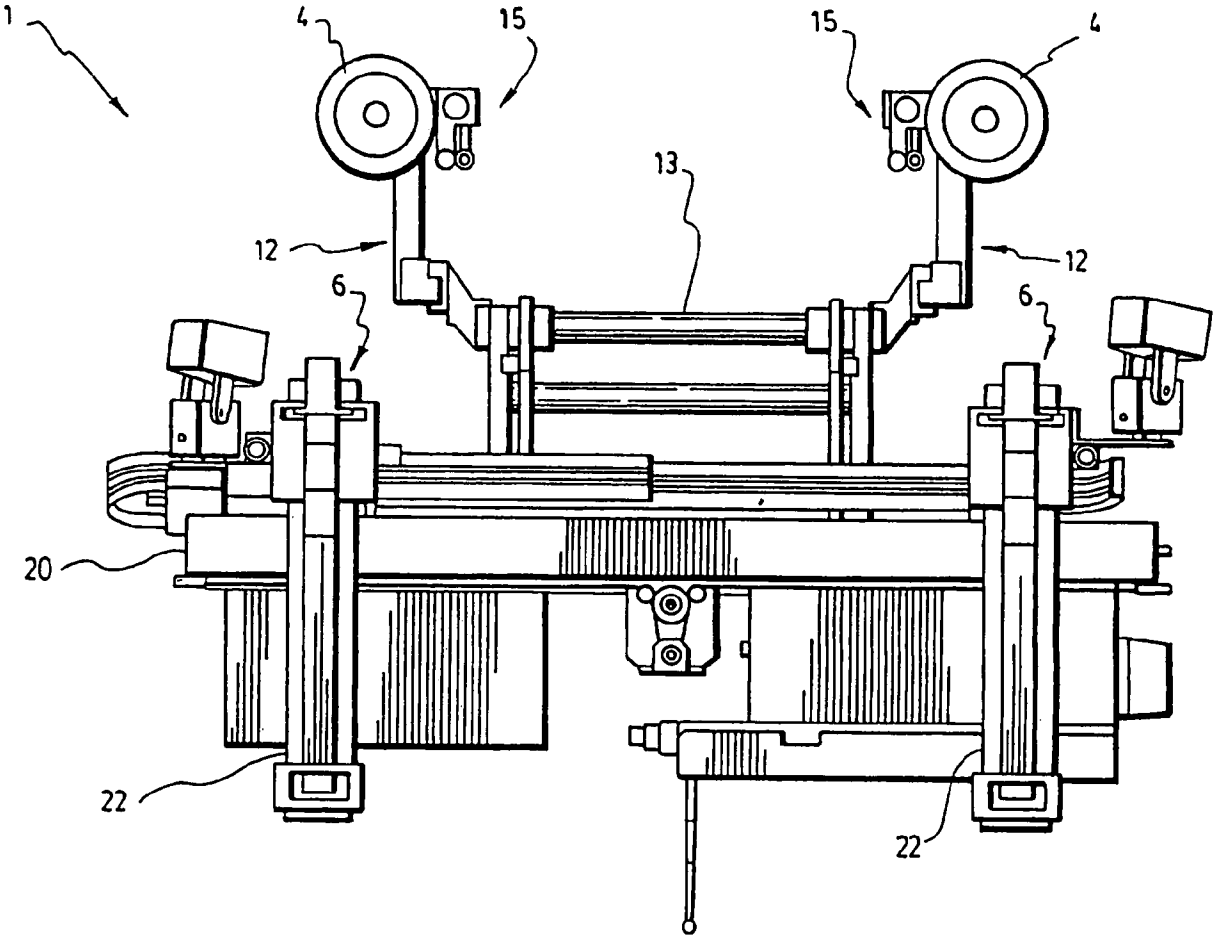
FIG. 6 is a side view of the vehicle shown at FIG. 5.
Figure 7:
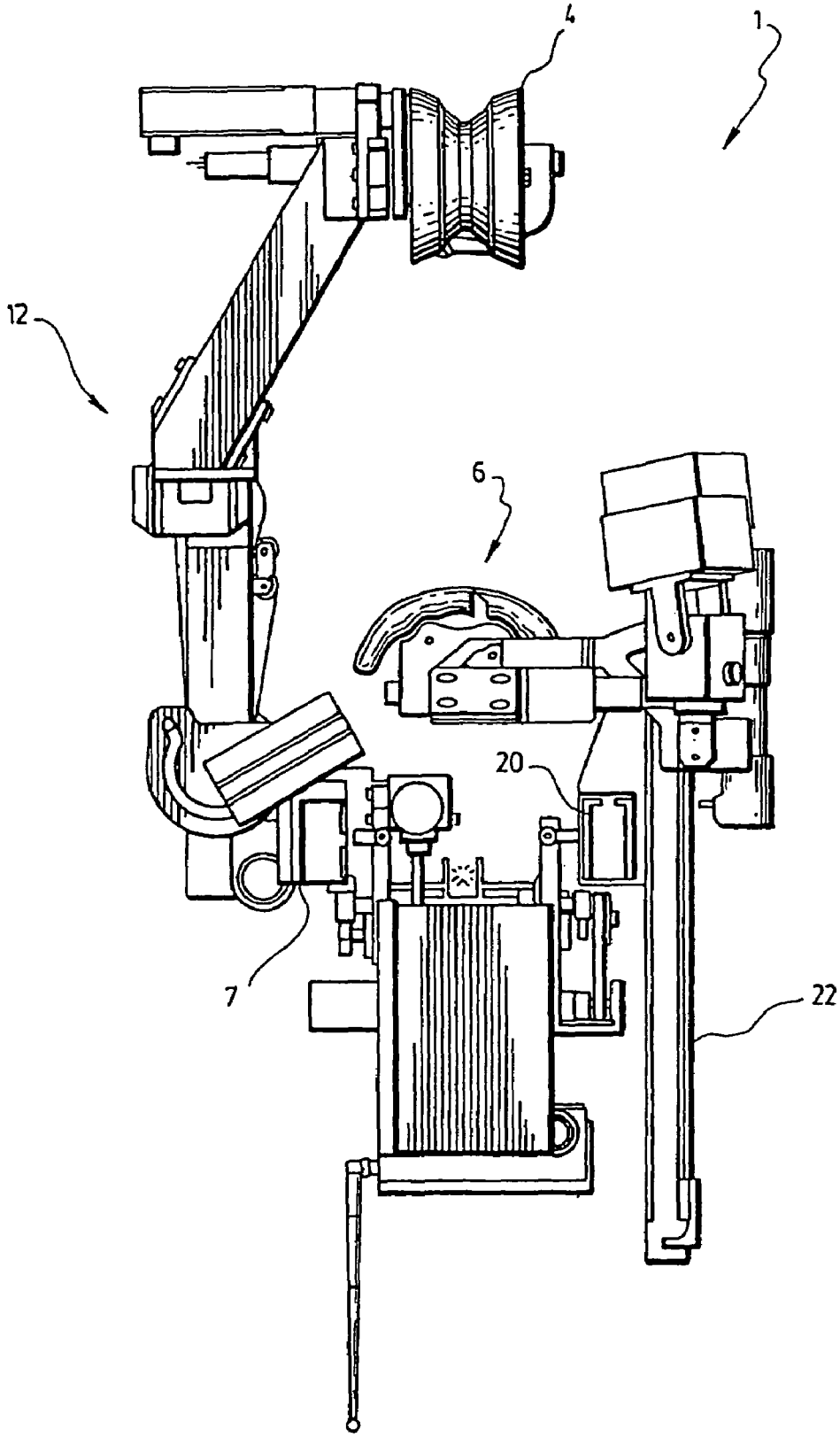
FIG. 7 is a front view of the vehicle shown at FIG. 5.
Figure 8:
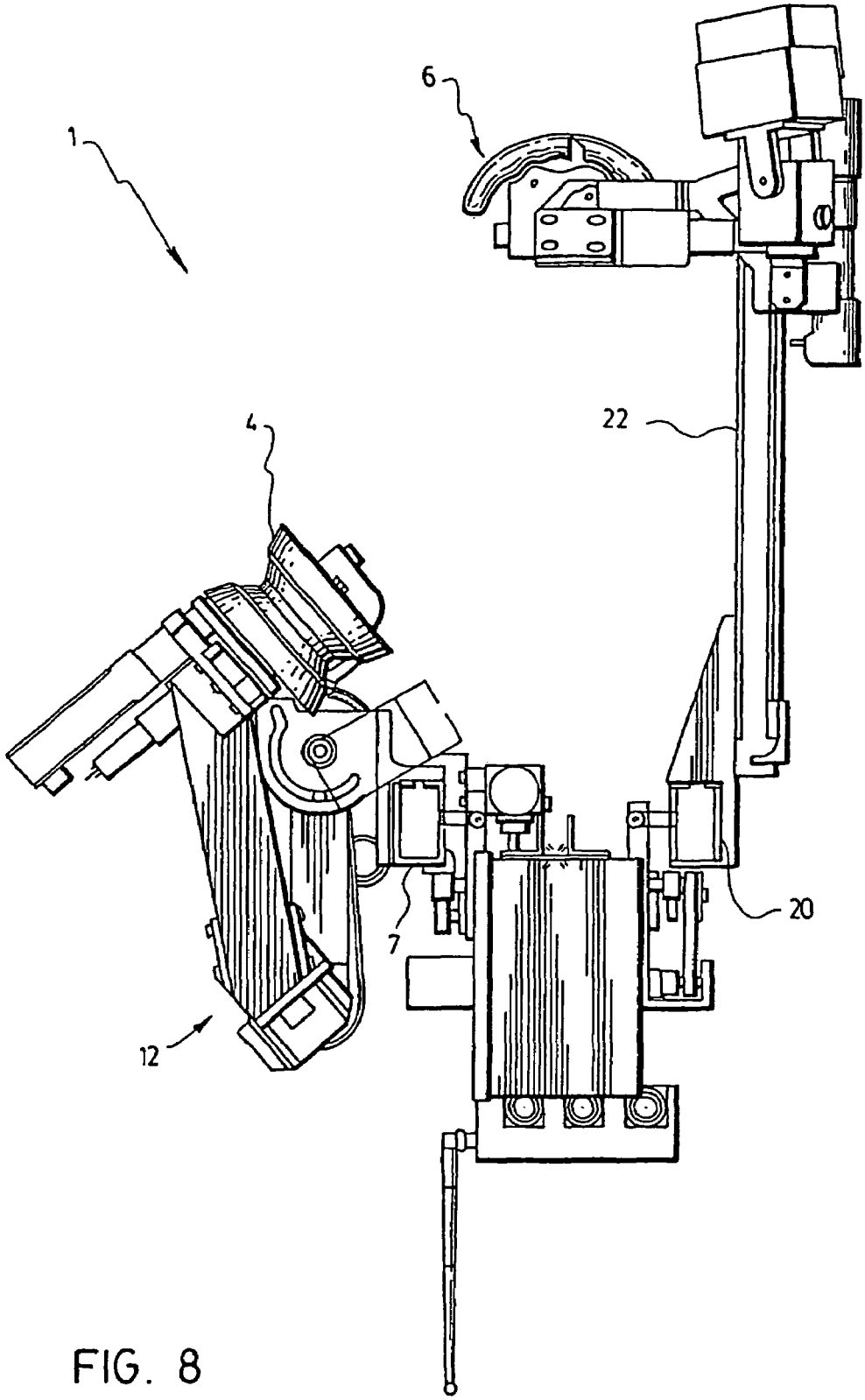
FIG. 8 is a front view of the vehicle shown at FIG. 5 with the wheels being lowered and the temporary holders being in high position.

The second advantage of this configuration is that an important part of the total mass of the vehicle is moved under the obstacle during the positioning phase of the temporary supports. In the same manner, when the vehicle is supported by the temporary supports and it is the wheel frame that moves under the obstacle to clear it, the central structure also progresses itself of half of the distance. Globally, the center of gravity of the vehicle is therefore displaced in a very progressive manner. FIG. 4 shows schematically the variation of the horizontal position of the frame of the wheels, of the support frames and that of the center of gravity. This characteristic will be decisive during the sizing of the components (motors, support structure, etc.) because it diminishes by two the values of the moments of force generated by the placement in overhanging of the center of gravity when obstacles are cleared.

Because of the change of slope that is present when a suspension clamp is cleared, it is advantageous to provide the vehicle with a rotation axis of rotation that allows the inclination of one of the frames with respect to the other. One strategically positions this center of rotation at the hart of the central structure so that it ensures a symmetric behavior during the passage of the obstacles which allow to keep as close as possible to the elements that one wishes to clear while at the same time minimizing the variation of the apparent height of the conductor as evaluated with respect to the support frame.

Furthermore, in a similar manner as it has been described in the previous paragraph, by allocating a maximum of useful mass at the level of this rotation axis, one also equally minimizes the mass that is overhanging when the frames are separated from one another, and thereby the size of the components ensuring the rotation of this degree of freedom.

The principle advantage of the vehicle according to the present invention with respect to the vehicles known in the prior art is that the wheelbase is relatively long with respect to the overall dimensions of the vehicle (30 inches with respect to 50 inches), which provides a good stability during these displacements on the conductor. Furthermore, this wheelbase is as great as the longest obstacle that can be cleared. These two characteristics are such that the vehicle is well proportioned with respect to the task to be accomplished and that each mobile frame may as well be the one that supports the other in a stable and sufficiently rigid manner, and this even if different sensors or intervention tools would be added to one of these mobile frames. This therefore provides a vehicle that is truly usable in on-site conditions and not only as a laboratory prototype. Furthermore, the present vehicle has been developed in consultation with the eventual users so as to be usable in network, in a reliable manner.

Types of Obstacles on which the Vehicle May Roll

The vehicle according to the present invention is designed to be able to roll on braided cables, made of aluminum or steel, whose diameter may vary between 0.5 inch and 2.3 inches. Furthermore, there can be found on these conductors jointing sleeves whose diameter may be up to 3.5 inches.

The protection trimmings are made of an assembly of rigid aluminum rods that are rolled in several numbers around the conductors so that they cover these completely, thereby increasing the proper diameter of the cable by about 1.0 inch. Sometimes, there can be found a tightening ring that completes the assembly at the extremities. The diameter of this ring is about 3.5 inches.

There can be found on the electrical networks a great variety of vibration dampers which are made of one or several masses linked to each other by flexible elements. The dampers are connected to the conductor by means of a fixation clamp so that the masses are suspended downwards. Furthermore, it is common to see a damper of this type being damaged, the masses being located thereby in a lower position, the flexible elements that hold them are thereby twisted in a permanent manner.

Another type of system destined to dampen the vibrations, observed especially on networks of a certain age, is made of a section of conductors called strap that is bolted on the top of the conductor and that joins the suspension clamp at the center. One can estimate to about 60 inches the total length of the strap, which is 30 inches on each side of the clamp.

Types of Obstacles that May be Cleared by the Vehicle

The conductors are supported at each pylon by components that are called suspension clamps. The suspension clamps are generally supported by one or many insulator strings and the conductor thereby forms an angle with respect to the vertical, going from a few degrees to 25 or 30 degrees for very long stretches. There exist numerous models of suspension clamps. The length of the clamps varies generally between 8 and 15 inches but several clamps destined to the stretches of highways or river crossings measure between 24 and 30 inches. Furthermore, there may also be a change in direction in the horizontal plan up to 10 degrees that is possible to clear with the vehicle according to the present invention.

Some suspension clamps are equipped of tubular rings called grading rings and these are intended to avoid the losses by arcing effect by making uniform the electric fields around the components. These rings are of various shapes.

Another type of damper, called torsion damper, has the form of a pair of spherical masses fixed one above the other and maintained on the cable by a clamp on the side of the cable. This type of damper is often found in pairs or installed in series of many dampers, positioned on both sides of the conductor. Furthermore, nothing guarantees that the angular position of the damper and this one may have turned around the conductor.

The vehicle according to the invention may clear marking systems on overhead ground wires and also sometimes on conductors close to water surfaces, to airports or to zones where the passage of aircrafts is frequent.

There exist at least three types of markers that are currently used that is the spherical marker of 24 inches or of 30 inches and the cylindrical marker of 16 inches of diameter and 12 inches long. This obstacle, as well as the others presented above, has been cleared in less than two minutes by an experienced operator. The capabilities of automation of the vehicle leave one to consider an even faster passage time.

Although the present invention has been described above by preferred embodiments thereof, it is to be understood that the invention is not limited to these precise embodiments and that various changes and modifications may be effected therein without departing from the scope or the spirit of the invention.

The invention claimed is:

1. A remote-controlled vehicle (1) intended to be mounted on a support (2) and capable to clear an obstacle (3) on the support (2), the vehicle (1) comprising:

a first frame (7);

a second frame (20) movably mounted on the first frame (7);

a first motor means connected between the first and second frames (7, 20) for longitudinally displacing the frames (7, 20) one with respect to the other between a compact position where the frames (7, 20) are superimposed one over the other and an extended position where the frames (7, 20) are moved away from one another;

at least one articulated arm (12) movably mounted on the first frame (7);

at least one wheel (4) mounted on the articulated arm (12) for holding the vehicle (1) onto the support (2), said at least one wheel (4) being a motorized traction wheel capable of displacing the vehicle (1) along the support (2);

attachment means (15) cooperating with said at least one wheel (4) and being capable of holding said wheel (4) on the support (2);

a second motor means connected between the first frame (7) and the articulated arm (12) for vertically displacing and pivoting the articulated arm (12) with respect to the first frame (7) so as to displace said at least one wheel (4) with respect to the support (2) between a removed position where said at least one wheel (4) is taken off from the support (2) and a support position where said at least one wheel (4) is mounted on the support (2);

at least one temporary support arm (22) movably mounted on the second frame (20), said at least one arm having a holding means (6) of the support (2), being capable of holding the vehicle (1) on the support (2); and a third motor means connected between the second frame (20) and the temporary support arm (22) for displacing vertically the temporary support arm (22) so as to raise and lower the holding means (6) between a high position where the holding means (6) is hanged on the support (2) and a lower position where the holding means (6) is taken off from the support (2).

2. The vehicle (1) according to claim 1, further comprising a fourth motor means for achieving a rotating of the frames (7, 20) one with respect to the other.

3. The vehicle (1) according to claim 2, wherein the fourth motor means comprises a motor (28) connected via a screw (29) to a screw gear (30) for carrying out a rotating of the frames (7, 20) one with respect to the other.

4. The vehicle (1) according to claim 1, wherein the vehicle (1) comprises a second articulated arm (12) movably mounted on the first frame (7) and longitudinally spaced with respect to the other articulated arm (12), a second wheel (4) being mounted on the second articulated arm (12) for holing the vehicle (1) onto the support (2), and another attachment means (15) being mounted on the second articulated arm (12).

5. The vehicle (1) according to claim 4, wherein each attachment means (15) comprises a pair of motorized rolls (15*b*), said rolls overhanging on each articulated arm (12).

6. The vehicle (1) according to claim 4, wherein the first motor means comprises a motor (38) connected via a rotation shaft (11) to a pulley and tooth belt system (39, 40) for achieving a translation of the frames (7, 20), one with respect to the other.

7. The vehicle (1) according to claim 4, wherein the second motor means comprises a motor (11*b*) connected via a rotation shaft (11) to a pulley and tooth belt system (19) for pivoting the articulated arms (12).

8. The vehicle (1) according to claim 4, wherein the third motor means comprises a motor (22*a*) connected via a belt (22*b*) to a central ball screw spindle (22*c*) for raising and lowering the temporary support arms (22).

9. The vehicle (1) according to claim 4, wherein the vehicle (1) comprises a second temporary support arm (22) movably mounted on the second frame (20) and longitudinally spaced with respect to the other temporary support arm (22), the second temporary support arm (22) having another holding means (6) for holding the vehicle (1) onto the support (2).

10. The vehicle (1) according to claim 9, wherein each holding means (6) comprises a motorized clamp (23) adapted to hold the support (2).

11. The vehicle (1) according to claim 9, wherein each articulated arm (12) has a proximal part (12*a*) pivotally mounted on the first frame (7) and a distal part (12*b*) pivotally mounted on the proximal part (12*a*), each wheel (4) being mounted on one extremity of the distal part (12*b*).

12. The vehicle (1) according to claim 11, wherein each of the wheels (4) has a central groove (4*a*) and splayed edges (4*b*) for receiving a support (2) having a conductor shape onto which the vehicle is adapted to move.

* * * * *